US010661871B2

(12) United States Patent
Koyano et al.

(10) Patent No.: US 10,661,871 B2
(45) Date of Patent: May 26, 2020

(54) WATERCRAFT

(71) Applicant: YAMAHA HATSUDOKI KABUSHIKI KAISHA, Iwata-shi, Shizuoka (JP)

(72) Inventors: Satoshi Koyano, Shizuoka (JP); Hirotaka Aoki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 61 days.

(21) Appl. No.: 15/911,517

(22) Filed: Mar. 5, 2018

(65) Prior Publication Data

US 2018/0273152 A1 Sep. 27, 2018

(30) Foreign Application Priority Data

Mar. 22, 2017 (JP) ..... 2017-056249

(51) Int. Cl.

| | |
|---|---|
| ***B63B 25/02*** | (2006.01) |
| ***B63H 20/12*** | (2006.01) |
| ***B63H 25/02*** | (2006.01) |
| ***B63H 20/16*** | (2006.01) |
| *B63H 20/00* | (2006.01) |

(52) U.S. Cl.

CPC ..... *B63H 20/12* (2013.01); *B63H 20/16* (2013.01); *B63H 25/02* (2013.01); *B63H 2020/003* (2013.01); *B63H 2025/022* (2013.01)

(58) Field of Classification Search

CPC ..... B63H 21/21; B63H 21/213; B63H 2021/216; B63H 21/22; B63H 21/24; B63H 21/26; B63H 21/265; B63H 25/02; B63H 2025/022; B63H 2025/024; B63H 2025/026; B63H 2025/028; B63H 25/04; B63H 2025/045; B63H 25/42; B63H 2025/425; B63H 25/44; B63H 25/46; B63H 2025/465; B63H 20/00; B63H 20/08; B63H 20/01; B60K 2026/028

See application file for complete search history.

(56) References Cited

U.S. PATENT DOCUMENTS

| | | | | |
|---|---|---|---|---|
| 7,278,367 | B1 * | 10/2007 | Gonring | B63H 21/213 114/144 R |
| 2005/0042951 | A1 * | 2/2005 | Morvillo | B63H 11/11 440/100 |
| 2005/0266743 | A1 * | 12/2005 | Okuyama | B63H 21/213 440/87 |
| 2014/0046515 | A1 * | 2/2014 | Mizutani | B63H 21/21 701/21 |
| 2015/0307176 | A1 | 10/2015 | Nakayasu | |
| 2016/0090167 | A1 * | 3/2016 | Gai | B63H 25/02 74/471 R |

FOREIGN PATENT DOCUMENTS

JP 2015-209144 A 11/2015

* cited by examiner

*Primary Examiner* — Andrew Polay

(74) *Attorney, Agent, or Firm* — Keating and Bennett, LLP

(57) ABSTRACT

A watercraft includes a transversely leftward moving switch and a transversely rightward moving switch attached to a steering wheel. A controller is configured or programmed to control a marine propulsion device so as to move a vessel body of the watercraft transversely leftward when the transversely leftward moving switch is operated. The controller is configured or programmed to control the marine propulsion device so as to move the vessel body transversely rightward when the transversely rightward moving switch is operated.

16 Claims, 18 Drawing Sheets

WATERCRAFT

CROSS REFERENCE TO RELATED APPLICATIONS

This application claims the benefit of priority to Japanese Patent Application No. 2017-056249 filed on Mar. 22, 2017. The entire contents of this application are hereby incorporated herein by reference.

BACKGROUND OF THE INVENTION

1. Field of the Invention

The present invention relates to a watercraft.

2. Description of the Related Art

There is a type of watercraft (an outboard motorboat, a jet boat, etc.) that includes a throttle operating member, a steering wheel and a joystick (see e.g., Japan Laid-open Patent Application Publication No. JP2015-209144A). The velocity of the watercraft is controlled in response to operating the throttle operating member. The watercraft is turned right and left in response to operating the steering wheel right and left. Additionally, the watercraft is transversely moved in a right-and-left direction in response to tilting the joystick right and left.

For example, a vessel operator moves the watercraft to the vicinity of a wharf by operating the throttle operating member and the steering wheel. Then, after the watercraft approaches some distance from the wharf, the vessel operator operates the joystick to dock the watercraft at the wharf.

As described above, in the well-known watercraft, the steering wheel and the joystick are disposed independently from each other. Therefore, the vessel operator is required to operate the steering wheel and the joystick, respectively, depending on situations such as docking of the watercraft. However, operating the joystick for transversely moving the watercraft is completely different from operating the steering wheel. Hence, when not familiar with operating the joystick, the vessel operator possibly feels uncomfortable.

SUMMARY OF THE INVENTION

Preferred embodiments of the present invention provide watercraft in which an operation of transverse movement is easily performed.

A watercraft according to a preferred embodiment of the present invention includes a vessel body, a marine propulsion device, a steering wheel, a transversely leftward moving switch, a transversely rightward moving switch, and a controller. The marine propulsion device is attached to the vessel body. The steering wheel is attached to the vessel body so as to be rotatable about a steering shaft. The transversely leftward moving switch is attached to the steering wheel. The transversely rightward moving switch is attached to the steering wheel. The controller is configured or programmed to control the marine propulsion device so as to move the vessel body transversely leftward when the transversely leftward moving switch is operated. The controller is configured or programmed to control the marine propulsion device so as to move the vessel body transversely rightward when the transversely rightward moving switch is operated.

In the watercraft according to a preferred embodiment of the present invention, a vessel operator is able to transversely move the watercraft by operating the transversely leftward moving switch and the transversely rightward moving switch. Additionally, the transversely leftward moving switch and the transversely rightward moving switch are attached to the steering wheel. Therefore, the vessel operator is able to operate the transversely leftward moving switch and the transversely rightward moving switch without releasing his/her hands far from the steering wheel. Consequently, a transverse movement of the watercraft is easily performed.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
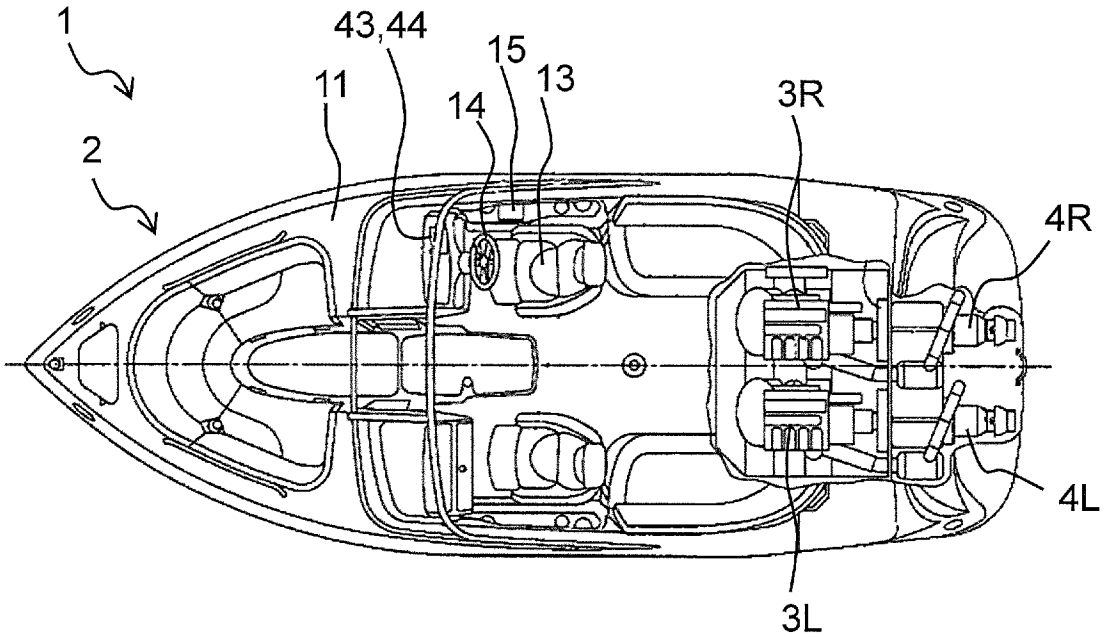
FIG. 1 is a plan view of a watercraft according to a preferred embodiment of the present invention.
Figure 2:
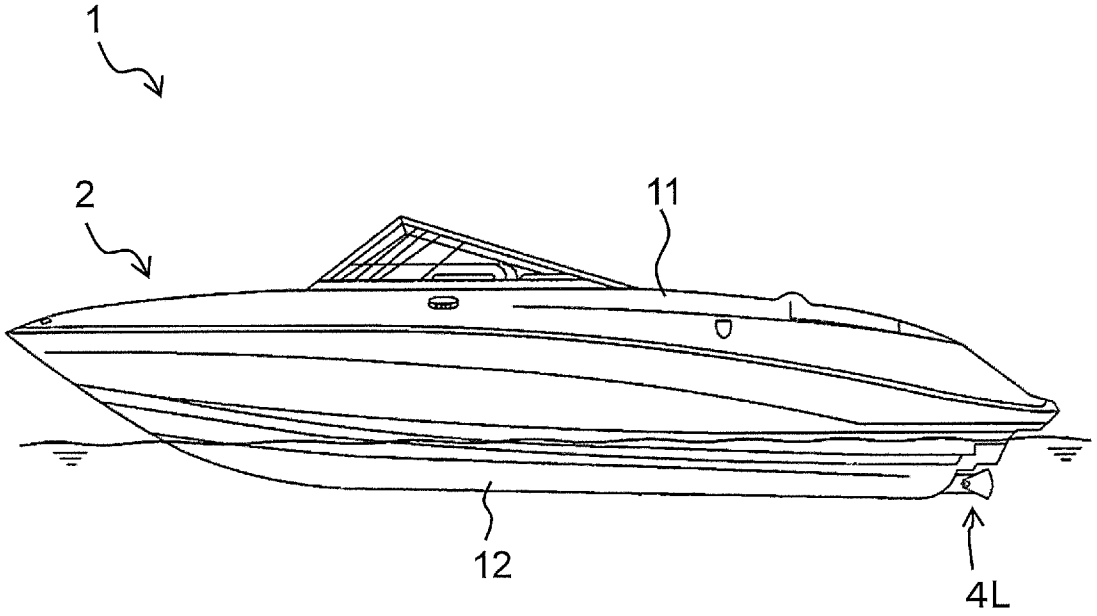
FIG. 2 is a side view of the watercraft.

A watercraft according to preferred embodiments will be hereinafter explained with reference to the drawings. FIG. 1 is a plan view of a watercraft 1. It should be noted that FIG. 1 shows a portion of an internal structure of the watercraft 1. FIG. 2 is a side view of the watercraft 1. In the present preferred embodiment, the watercraft 1 is, for example, a jet propulsion watercraft, which is a type of watercraft called a jetboat or a sport boat.

The watercraft 1 includes a vessel body 2, engines 3L and 3R, and marine propulsion devices 4L and 4R. The vessel body 2 includes a deck 11 and a hull 12. The hull 12 is disposed below the deck 11. An operator seat 13 is disposed on the deck 11.

The watercraft 1 includes, for example, two engines 3L and 3R and two marine propulsion devices 4L and 4R. More specifically, the watercraft 1 includes a first engine 3L and a second engine 3R. The watercraft 1 includes a first marine propulsion device 4L and a second marine propulsion device 4R. It should be noted that the number of engines is not limited to two, and alternatively, may be one or may be three or greater. The number of marine propulsion devices is not limited to two, and alternatively, may be one or may be three or greater.

The first engine 3L and the second engine 3L are housed in the vessel body 2. The output shaft of the first engine 3L is connected to the first marine propulsion device 4L. The output shaft of the second engine 3L is connected to the second marine propulsion device 4R. The first marine propulsion device 4L is driven by the first engine 3L, and generates a thrust to move the vessel body 2. The second marine propulsion device 4R is driven by the second engine 3L, and generates a thrust to move the vessel body 2. The first and second marine propulsion devices 4L and 4R are disposed right and left in alignment with each other.

Figure 3:
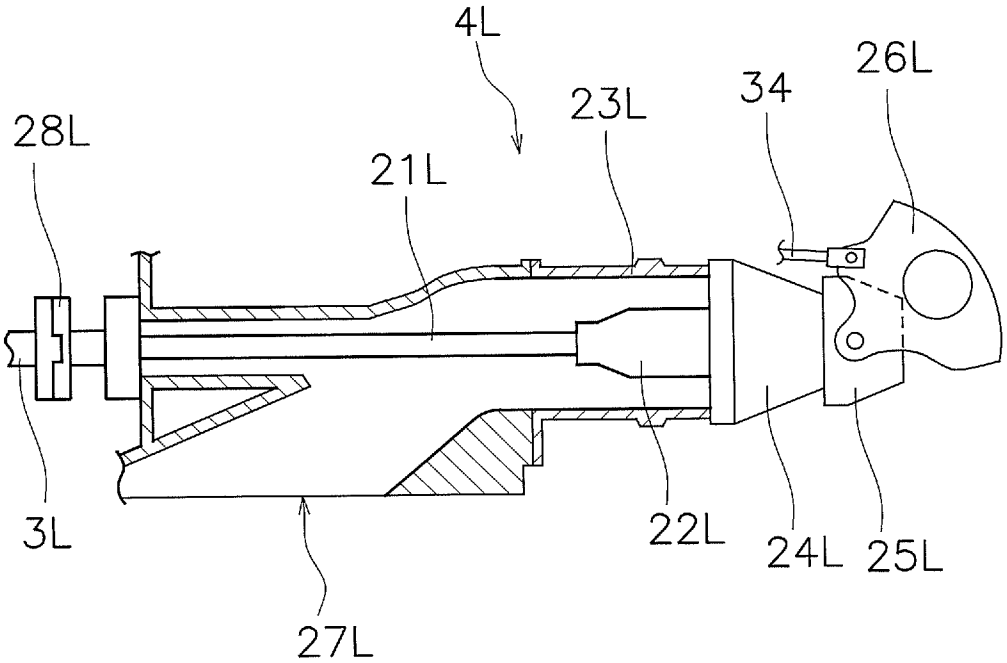
FIG. 3 is a cross-sectional side view of a marine propulsion device.

The first marine propulsion device 4L is a jet propulsion device that sucks in and ejects water to the surroundings of the vessel body 2. FIG. 3 is a side view of the first marine propulsion device 4L. It should be noted that FIG. 3 shows a portion of the first marine propulsion device 4L in a cross-sectional view.

As shown in FIG. 3, the first marine propulsion device 4L includes a first impeller shaft 21L, a first impeller 22L, a first impeller housing 23L, a first nozzle 24L, a first deflector 25L and a first reverse bucket 26L. The first impeller shaft 21L extends in a back-and-forth direction. The front portion of the first impeller shaft 21L is connected to the output shaft of the engine 3L through a coupling 28L. The rear portion of the first impeller shaft 21L is disposed inside the first impeller housing 23L. The first impeller housing 23L is disposed behind a water suction portion 27L. The first nozzle 24L is disposed behind the first impeller housing 23L.

The first impeller 22L is attached to the rear portion of the first impeller shaft 21L. The first impeller 22L is disposed inside the first impeller housing 23L. The first impeller 22L is rotated together with the first impeller shaft 21L in order to cause the water suction portion 27L to draw in water. The first impeller 22L ejects the drawn in water backward through the first nozzle 24L.

The first deflector 25L is disposed behind the first nozzle 24L. The first reverse bucket 26L is disposed behind the first deflector 25L. The first deflector 25L turns the direction of water ejected through the first nozzle 24L in a right-and-left direction. In other words, the moving direction of the watercraft 1 is changed right and left by changing the orientation of the first deflector 25L in the right-and-left direction.

The first reverse bucket 26L is switchable to a forward moving position, a backward moving position, and a neutral position. When the first reverse bucket 26L is located in the forward moving position, the water is ejected backward through the first nozzle 24L. The watercraft 1 is thus moved forward. When in the backward moving position, the first reverse bucket 26L turns the direction of water ejected through the first nozzle 24L to the forward direction. The watercraft 1 is thus moved backward.

The neutral position is a position located between the forward moving position and the backward moving position. When in the neutral position, the first reverse bucket 26L changes the direction of the stream of water ejected through the first nozzle 24L to the leftward and rightward directions of the vessel body 2. Therefore, when in the neutral position, the first reverse bucket 26L reduces the thrust to move the vessel body 2 forward. The vessel body 2 is thus decelerated, or is maintained in a stop position. Although not shown in the drawings, the second marine propulsion device 4R has a similar structure to the first marine propulsion device 4L.

Figure 4:
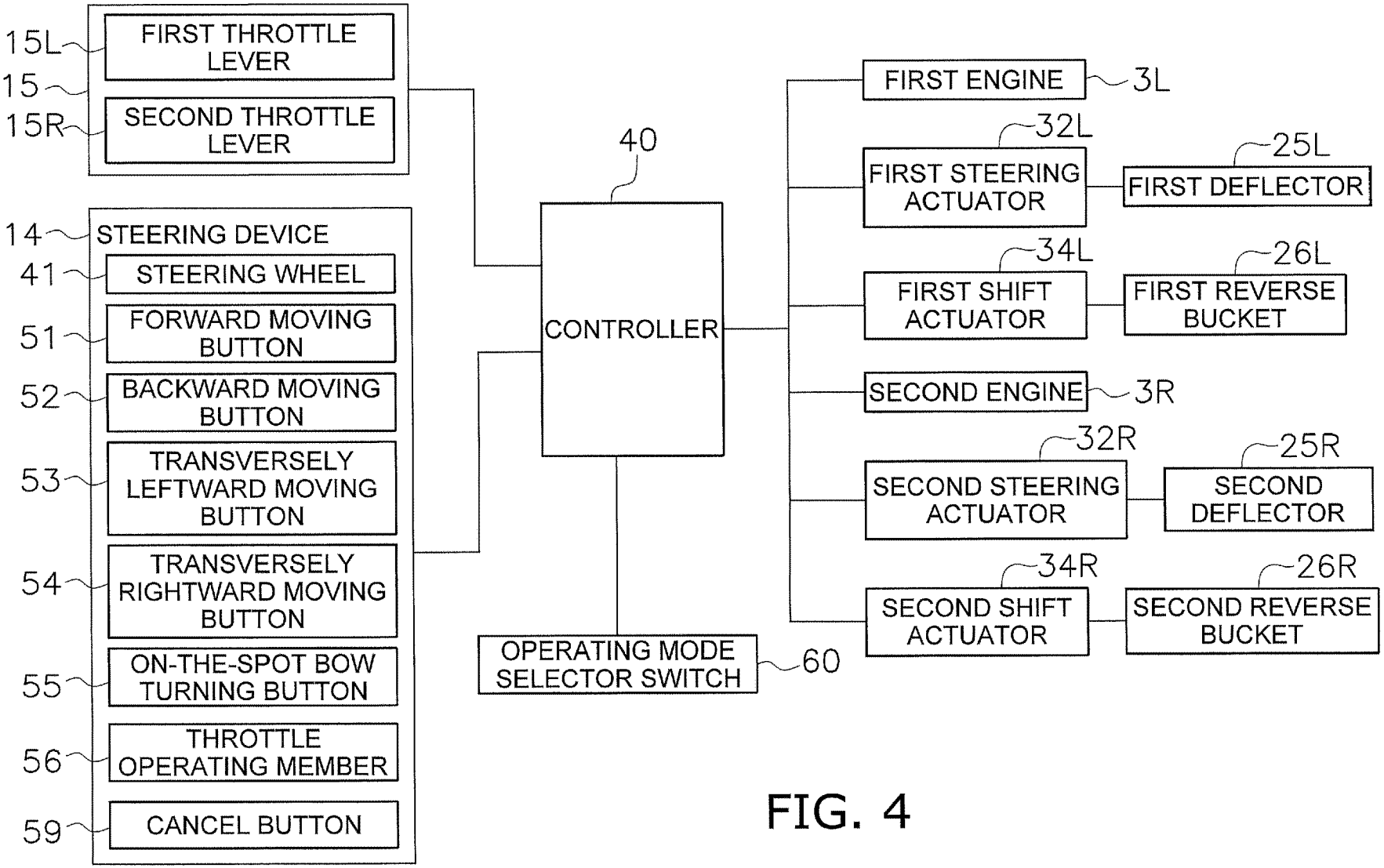
FIG. 4 is a schematic view of a control system of the watercraft.

Next, a control system of the watercraft 1 will be explained. FIG. 4 is a schematic diagram showing the control system of the watercraft 1. As shown in FIG. 4, the watercraft 1 includes a controller 40. The controller 40 includes a processor such as a CPU and storage devices such as an RAM and an ROM, and is configured or programmed to control the watercraft 1.

The watercraft 1 includes a first steering actuator 32L and a first shift actuator 34L. The controller 40 is connected to the first engine 3L, the first steering actuator 32L, and the first shift actuator 34L in a communicable manner.

The first steering actuator 32L is connected to the first deflector 25L of the first marine propulsion device 4L. The first steering actuator 32L changes a rudder angle of the first deflector 25L. The first steering actuator 32L is, for instance, an electric motor. Alternatively, the first steering actuator 32L may be another type of actuator such as a hydraulic cylinder.

The first shift actuator 34L is connected to the first reverse bucket 26L of the first marine propulsion device 4L. The first shift actuator 34L switches the position of the first reverse bucket 26L among the forward moving position, the backward moving position, and the neutral position. The first shift actuator 34L is, for instance, an electric motor. Alternatively, the first shift actuator 34L may be another type of actuator such as a hydraulic cylinder.

The watercraft 1 includes a second steering actuator 32R and a second shift actuator 34R. The second steering actuator 32R is connected to a second deflector 25R of the second marine propulsion device 4R. The second shift actuator 34R is connected to a second reverse bucket 26R of the second marine propulsion device 4R. These elements control the second marine propulsion device 4R, and have similar structures to the first steering actuator 32L and first shift actuator 34L described above. The controller 40 is connected to the second steering actuator 32R and the second shift actuator 34R in a communicable manner.

It should be noted that the controller 40 may include a plurality of controllers separate from each other. Alternatively, the controller 40 may be a single device.

The watercraft 1 includes a steering device 14 and a remote control unit 15. The controller 40 is connected to the steering device 14 and the remote control unit 15 in a communicable manner.

The remote control unit 15 is disposed at the operator seat 13. The remote control unit 15 is operated to regulate an output from each engine 3L, 3R and to switch between forward movement and backward movement. The remote control unit 15 includes a first throttle lever 15L and a second throttle lever 15R. Each of the first and second throttle levers 15L and 15R is operable from a zero operating position to a forward moving directional side and a backward moving directional side.

The remote control unit 15 outputs signals indicating the operating amount and the operating direction of each of the first and second throttle levers 15L and 15R. The controller 40 controls the rotational speed of the first engine 3L in accordance with the operating amount of the first throttle lever 15L. The controller 40 controls the rotational speed of the second engine 3L in accordance with the operating amount of the second throttle lever 15R.

The controller 40 controls the first shift actuator 34L in accordance with the operating direction of the first throttle lever 15L. The controller 40 controls the second shift actuator 34R in accordance with the operating direction of the second throttle lever 15R. Movement of the watercraft 1 is thus switched between forward movement and backward movement.

Figure 5:
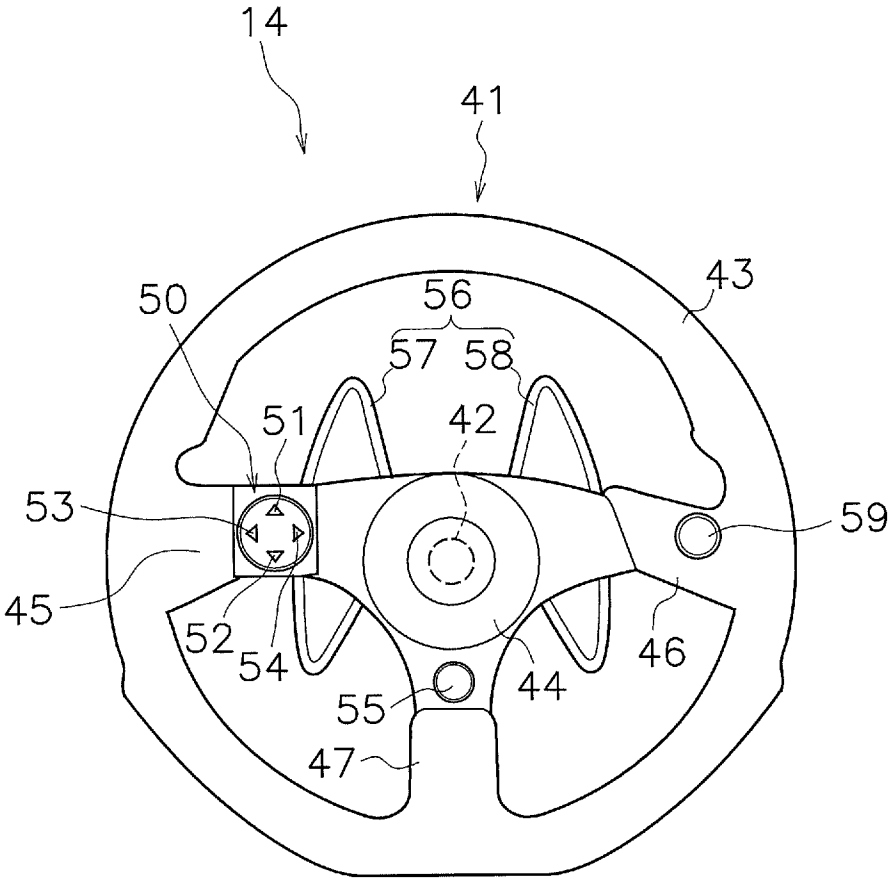
FIG. 5 is a diagram showing a steering device according to a first preferred embodiment of the present invention.

The steering device 14 is disposed at the operator seat 13. FIG. 5 is a diagram showing the steering device 14 according to a first preferred embodiment. The steering device 14 includes a steering wheel 41 and a plurality of moving switches 50 to 56 to move the vessel body 2.

The steering wheel 41 is attached to the vessel body 2 while being rotatable about a steering shaft 42. The steering wheel 41 is operated to steer the vessel body 2. In other words, the controller 40 controls the bow direction of the vessel body 2 in response to operation of the steering wheel 41. It should be noted that in FIG. 5, the steering wheel 41 is located in a middle position. The middle position is an operating position of the steering wheel 41 when moving the vessel body 2 straight. The steering device 14 outputs an operating signal, which indicates the operating position of the steering wheel 41, to the controller 40.

The controller 40 controls each steering actuator 32L, 32R in response to operation of the steering wheel 41. The bow direction of the vessel body 2 is thus changed to the right and left. More specifically, when the steering wheel 41 is turned to a position leftward of the middle position, the controller 40 outputs a command signal to each steering actuator 32L, 32R so as to change the bow direction of the vessel body 2 to the leftward direction. When the steering wheel 41 is turned to a position rightward of the middle position, the controller 40 outputs a command signal to each steering actuator 32L, 32R so as to change the bow direction of the vessel body 2 to the rightward direction.

The steering wheel 41 includes a wheel portion 43, a middle portion 44, and a plurality of spokes 45, 46, and 47. The wheel portion 43 preferably has an annular shape. The wheel portion 43 is held by a vessel operator. The middle portion 44 is disposed in the center of the steering wheel 41. The middle portion 44 is attached to the vessel body 2 while being rotatable about the steering shaft 42.

The plurality of spokes 45, 46, and 47 couple the wheel portion 43 and the middle portion 44 to each other. The plurality of spokes 45, 46 and 47 include a left spoke 45, a right spoke 46, and a down spoke 47. The left spoke 45 is located leftward of the steering shaft 42. The left spoke 45 extends leftward from the middle portion 44. The right spoke 46 is located rightward of the steering shaft 42. The right spoke 46 extends rightward from the middle portion 44. The down spoke 47 is located below the steering shaft 42. The down spoke 47 extends downward from the middle portion 44.

The plurality of moving switches 50 to 56 include a four directional key 50, an on-the-spot bow turning switch 55, and a throttle operating member 56. The four directional key 50 is attached to the steering wheel 41. The four directional key 50 is disposed on one side of the steering shaft 42 in the right-and-left direction. In the present preferred embodiment, the four directional key 50 is disposed leftward of the steering shaft 42. The four directional key 50 is disposed on the left spoke 45. It should be noted that the four directional key 50 may be disposed rightward of the steering shaft 42.

The four directional key 50 includes a forward moving switch 51, a backward moving switch 52, a transversely leftward moving switch 53, and a transversely rightward moving switch 54. The forward moving switch 51, the backward moving switch 52, the transversely leftward moving switch 53, and the transversely rightward moving switch 54 correspond to the front, back, left and right directional keys, respectively. In other words, the forward moving switch 51 is disposed in front of the center of the four directional key 50. The backward moving switch 52 is disposed behind the center of the four directional key 50. The transversely leftward moving switch 53 is disposed leftward of the center of the four directional key 50. The transversely rightward moving switch 54 is disposed rightward of the center of the four directional key 50. The forward moving switch 51, the backward moving switch 52, the transversely leftward moving switch 53, and the transversely rightward moving switch 54 are, for example, push-button switches, respectively.

The forward moving switch 51 is operated to start a forward moving mode to move the vessel body 2 forward. The backward moving switch 52 is operated to start a backward moving mode to move the vessel body 2 backward. The transversely leftward moving switch 53 is operated to start a transversely leftward moving mode to move the vessel body 2 transversely leftward. The transversely rightward moving switch 54 is operated to start a transversely rightward moving mode to move the vessel body 2 transversely rightward.

The steering device 14 outputs an operating signal, which indicates operation of the four directional key 50, to the controller 40. In other words, the steering device 14 outputs, to the controller 40, an operating signal indicting which one of the forward moving switch 51, the backward moving switch 52, the transversely leftward moving switch 53, and the transversely rightward moving switch 54 has been pushed.

The on-the-spot bow turning switch 55 is attached to the steering wheel 41. The on-the-spot bow turning switch 55 is a switch to start an on-the-spot bow turning mode to turn the vessel body 2 on the spot. The on-the-spot bow turning switch 55 is, for example, a push-button switch. In the present preferred embodiment, the on-the-spot bow turning switch 55 is disposed on the down spoke 47. The steering device 14 outputs an operating signal indicating operation of the on-the-spot bow turning switch 55 to the controller 40. In other words, the steering device 14 outputs, to the controller 40, an operating signal indicating that the on-the-spot bow turning switch 55 has been pushed.

The throttle operating member 56 is attached to the steering wheel 41. The throttle operating member 56 regulates the rotational speed of the first engine 3L and the second engine 3L. The throttle operating member 56 includes a left lever 57 and a right lever 58. The left lever 57 is disposed leftward of the steering shaft 42. The right lever 58 is disposed rightward of the steering shaft 42.

The left lever 57 and the right lever 58 are attached to the throttle operating member 56, while being movable back and forth. Each of the left and right levers 57 and 58 is operable to an arbitrary position between a zero operating position and a maximum operating position. The steering device 14 outputs a signal, which indicates the operating amount of each of the left and right levers 57 and 58, to the controller 40.

It should be noted that the left and right levers 57 and 58 may be separate from each other. Alternatively, the left and right levers 57 and 58 may be integral with each other.

The steering device 14 includes a cancel switch 59. The cancel switch 59 is attached to the steering wheel 41. The cancel switch 59 is, for example, a push-button switch. The cancel switch 59 terminates each of the moving modes described above. The steering device 14 outputs an operating signal, which indicates operation of the cancel switch 59, to the controller 40. In other words, the steering device 14 outputs, to the controller 40, an operating signal indicating that the cancel switch 59 has been pushed. When the cancel switch 59 is pushed, the controller 40 terminates an ongoing moving mode and controls each marine propulsion device 4L, 4R so as to stop the vessel body 2.

As shown in FIG. 4, the watercraft 1 includes an operating mode selector switch 60. For example, the operating mode selector switch 60 is disposed in a position near the operator seat 13. Alternatively, the operating mode selector switch 60 may be disposed on the steering wheel 41. The operating mode selector switch 60 switches the operating mode of the watercraft 1 between a first operating mode and a second operating mode. A signal, which indicates operation of the operating mode selector switch 60, is inputted to the controller 40.

In the first operating mode, the controller 40 controls, as described above, each marine propulsion device 4L, 4R in response to operation of the remote control unit 15. In the second operating mode, the controller 40 controls each marine propulsion device 4L, 4R in response to operation of any of the plurality of moving switches 50 to 55 and the throttle operating member 56 of the steering device 14. It should be noted that in both the first and second operating modes, operation of the watercraft may be enabled in response to operating the steering wheel 41.

The moving modes in the second operating mode will be hereinafter explained. It should be noted that before starting each moving mode, the operating amount of the throttle operating member 56 is assumed to be 0 and each reverse bucket 26L, 26R is assumed to be located in the neutral position.

Figure 6:
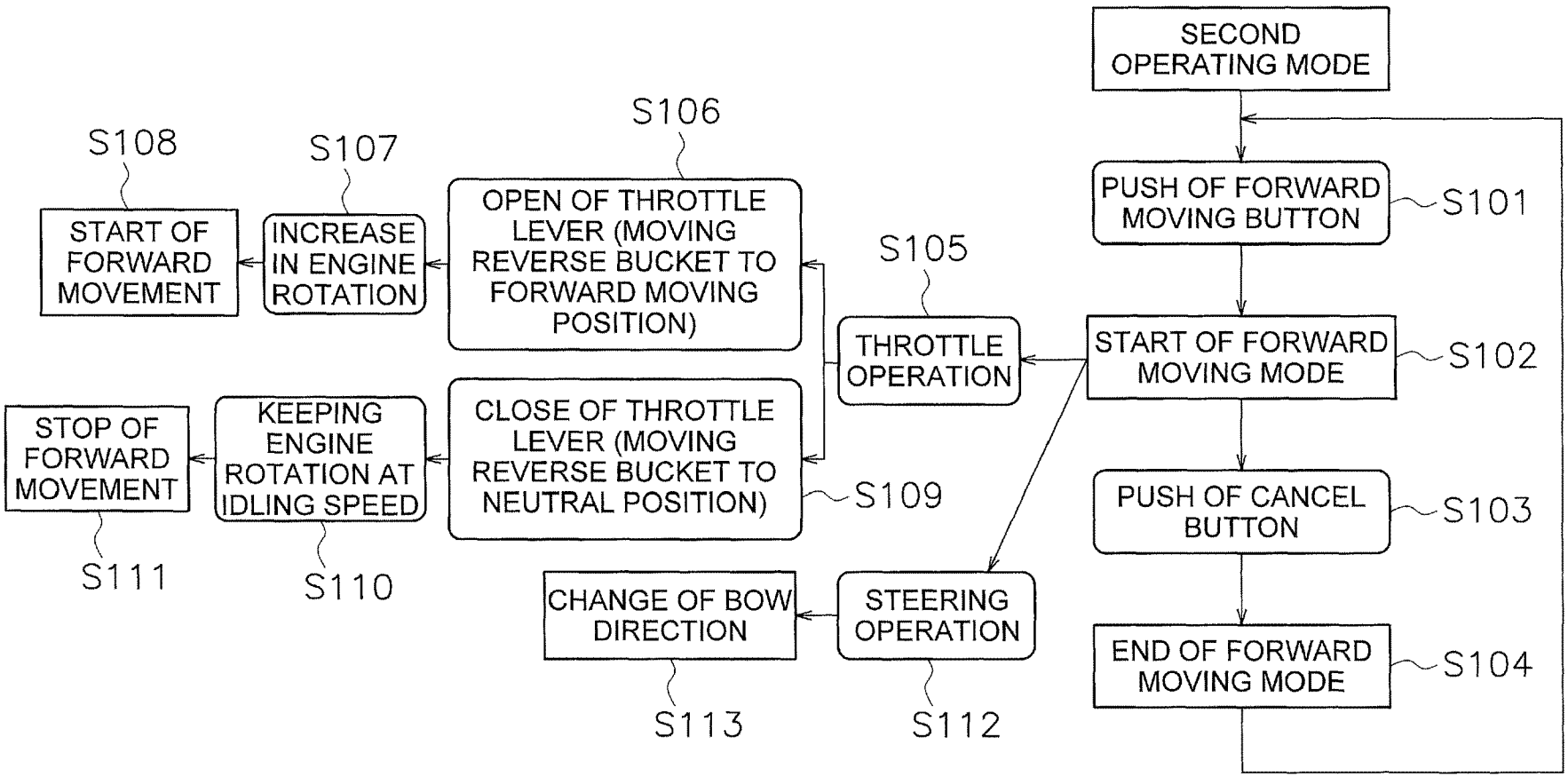
FIG. 6 is a diagram showing a flow of operations in a forward moving mode.

FIG. 6 is a diagram showing a flow of operations in the forward moving mode. As shown in FIG. 6, when the forward moving switch 51 is pushed (S101), the forward moving mode is started (S102). When the throttle operating member 56 is operated during the forward moving mode (S105), the controller 40 controls each marine propulsion device 4L, 4R in response to the operation of the throttle operating member 56. It should be noted that operating the throttle operating member 56 may refer to operating only one of the left and right levers 57 and 58.

More specifically, when the vessel operator opens the throttle operating member 56, in other words, when the throttle operating member 56 is operated from the zero operating position, the controller 40 moves each reverse bucket 26L, 26R from the neutral position to the forward moving position (S106). Additionally, the controller 40 increases the engine rotational speed of each engine 3L, 3R (S107). The vessel body 2 thus starts moving forward (S108).

During forward movement of the vessel body 2, the controller 40 controls the engine rotational speed of each engine 3L, 3R in accordance with the operating amount of the throttle operating member 56. Therefore, the vessel operator is able to regulate the forward velocity of the vessel body 2 by operating the throttle operating member 56 during the forward moving mode.

When the vessel operator closes the throttle operating member 56, in other words, when the throttle operating member 56 is returned to the zero operating position, the controller 40 moves each reverse bucket 26L, 26R from the forward moving position to the neutral position (S109). Additionally, the controller 40 maintains the engine rotational speed of each engine 3L, 3R at an idling rotational speed (S110). The vessel body 2 thus stops moving forward (S111).

It should be noted that when the steering wheel 41 is operated during forward movement (S112), the controller 40 outputs a command signal to each steering actuator 32L, 32R so as to change the bow direction to the right and left in response to the operation of the steering wheel 41 (S113). The vessel body 2 thus turns the bow thereof to the right and left, while moving forward. When the cancel switch 59 is pushed during the forward moving mode (S103), the forward moving mode is terminated and the vessel body 2 stops (S104).

Figure 7:
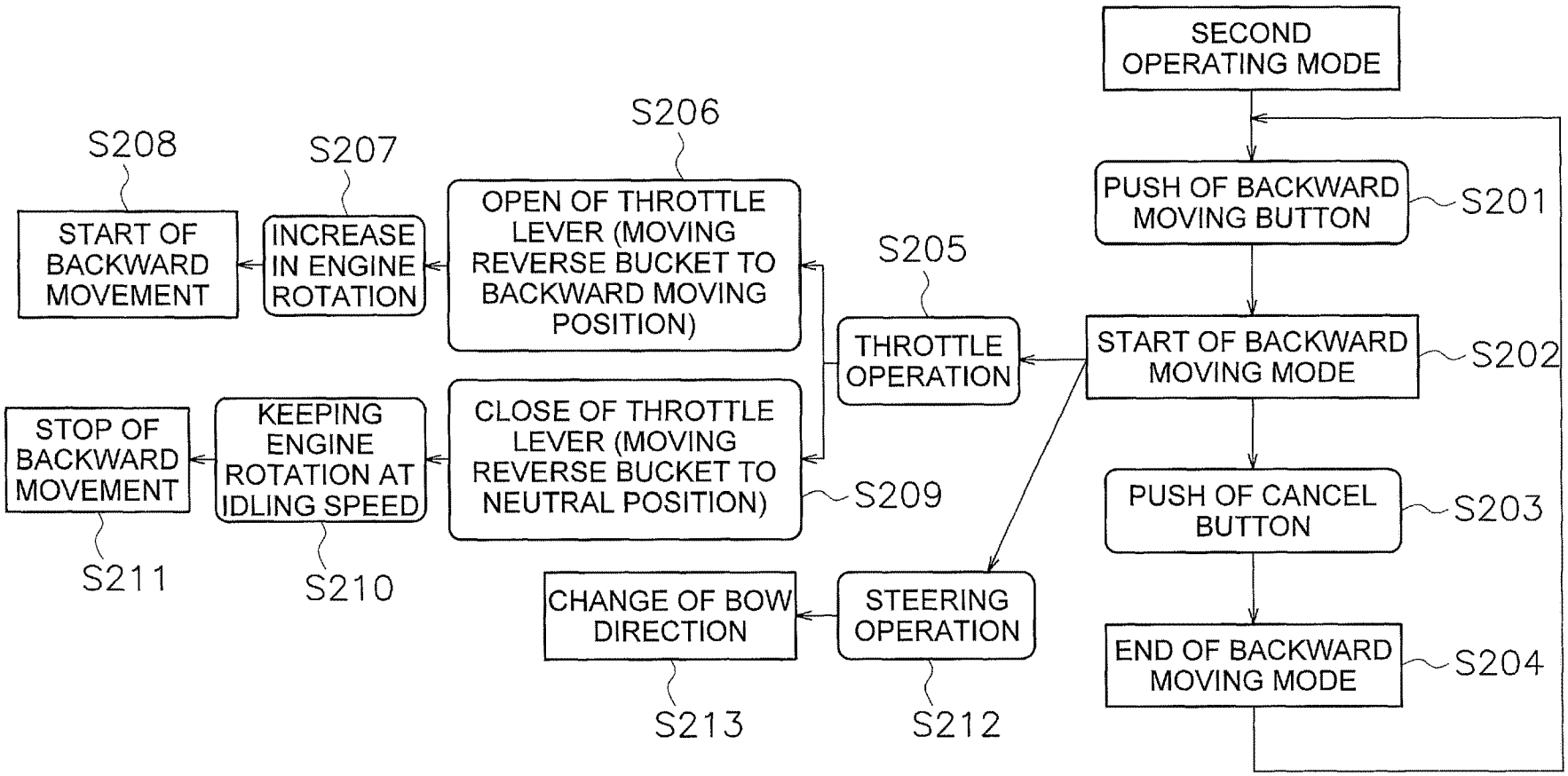
FIG. 7 is a diagram showing a flow of operations in a backward moving mode.

FIG. 7 is a diagram showing a flow of operations in the backward moving mode. As shown in FIG. 7, when the backward moving switch 52 is pushed (S201), the backward moving mode is started (S202). When the throttle operating member 56 is operated during the backward moving mode (S205), the controller 40 controls each marine propulsion device 4L, 4R in response to the operation of the throttle operating member 56. More specifically, when the vessel operator opens the throttle operating member 56, the controller 40 moves each reverse bucket 26L, 26R from the neutral position to the backward moving position (S206). Additionally, the controller 40 increases the engine rotational speed of each engine 3L, 3R (S207). The vessel body 2 thus starts moving backward (S208).

During backward movement of the vessel body 2, the controller 40 controls the engine rotational speed of each engine 3L, 3R in accordance with the operating amount of the throttle operating member 56. Therefore, the vessel operator is able to regulate the backward velocity of the vessel body 2 by operating the throttle operating member 56 during the backward moving mode.

When the vessel operator closes the throttle operating member 56, the controller 40 moves each reverse bucket 26L, 26R from the backward moving position to the neutral position (S209). Additionally, the controller 40 maintains the engine rotational speed of each engine 3L, 3R at the idling rotational speed (S201). The vessel body 2 thus stops moving backward (S211).

It should be noted that when the steering wheel 41 is operated during backward movement (S212), the controller 40 outputs a command signal to each steering actuator 32L, 32R so as to change the bow direction to the right and left in response to the operation of the steering wheel 41 (S213). The vessel body 2 thus turns the bow thereof to the right and left, while moving backward. When the cancel switch 59 is pushed during the backward moving mode (S203), the backward moving mode is terminated (S204).

Figure 8:
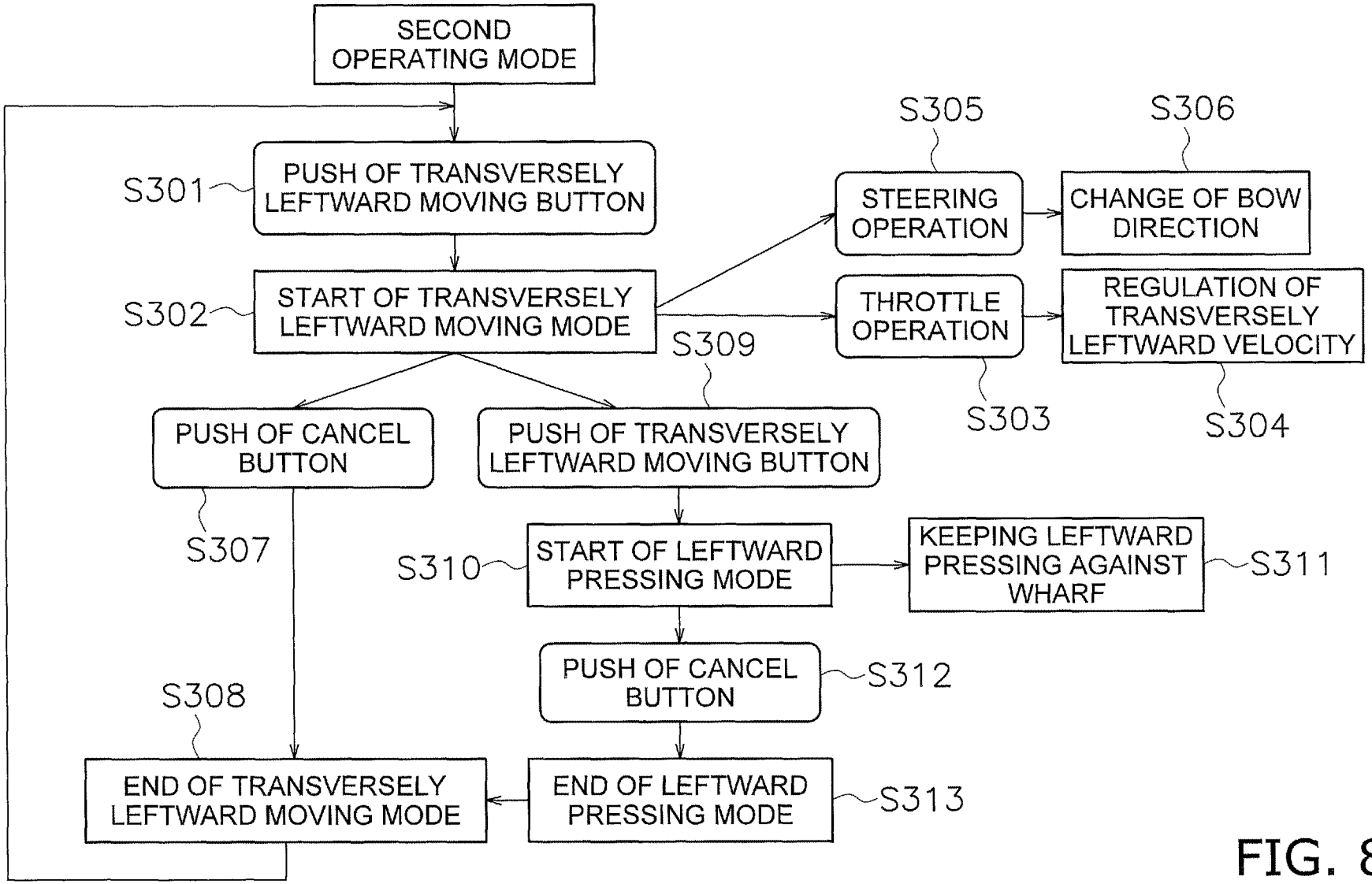
FIG. 8 is a diagram showing a flow of operations in a transversely leftward moving mode.

FIG. 8 is a diagram showing a flow of operations in the transversely leftward moving mode. As shown in FIG. 8, when the transversely leftward moving switch 53 is pushed (S301), the transversely leftward moving mode is started (S302). When the throttle operating member 56 is operated during the transversely leftward moving mode (S303), the controller 40 controls the engine rotational speed of each engine 3L, 3R in accordance with the operating amount of the throttle operating member 56. Therefore, the vessel operator is able to regulate the transversely leftward velocity of the vessel body 2 by operating the throttle operating member 56 during the transversely leftward moving mode (S304). Alternatively, the controller 40 may reduce the transversely leftward velocity of the vessel body 2 in response to pushing the transversely rightward moving switch 54 during the transversely leftward moving mode.

It should be noted that when the steering wheel 41 is operated during transversely leftward movement (S305), the controller 40 outputs a command signal to each steering actuator 32L, 32R so as to change the bow direction to the right and left in response to the operation of the steering wheel 41 (S306). Therefore, the vessel operator is able to turn the bow of the vessel body 2 to the right and left by operating the steering wheel 41 during the transversely leftward moving mode. When the cancel switch 59 is pushed during the transversely leftward moving mode (S307), the transversely leftward moving mode is terminated and the vessel body 2 stops (S308).

When the transversely leftward moving switch 53 is pushed during transversely leftward movement (S309), a leftward pressing mode is started (S310). In the leftward pressing mode, the controller 40 controls each marine propulsion device 4L, 4R so as to maintain a state that the vessel body 2 is pressed leftward against a place for docking such as a wharf (S311). More specifically, the controller 40 outputs command signals to each engine 3L, 3R and each steering actuator 32L, 32R so as to maintain a leftward thrust. When the cancel switch 59 is pushed during the leftward pressing mode (S312), the leftward pressing mode is terminated (S313).

It should be noted that the leftward pressing mode may be started when the transversely leftward moving switch 53 is pushed and held during transversely leftward movement. In other words, the leftward pressing mode may be started when the transversely leftward moving switch 53 is kept pushed for a predetermined period of time or greater (e.g., about several seconds) during transversely leftward movement.

Figure 9:
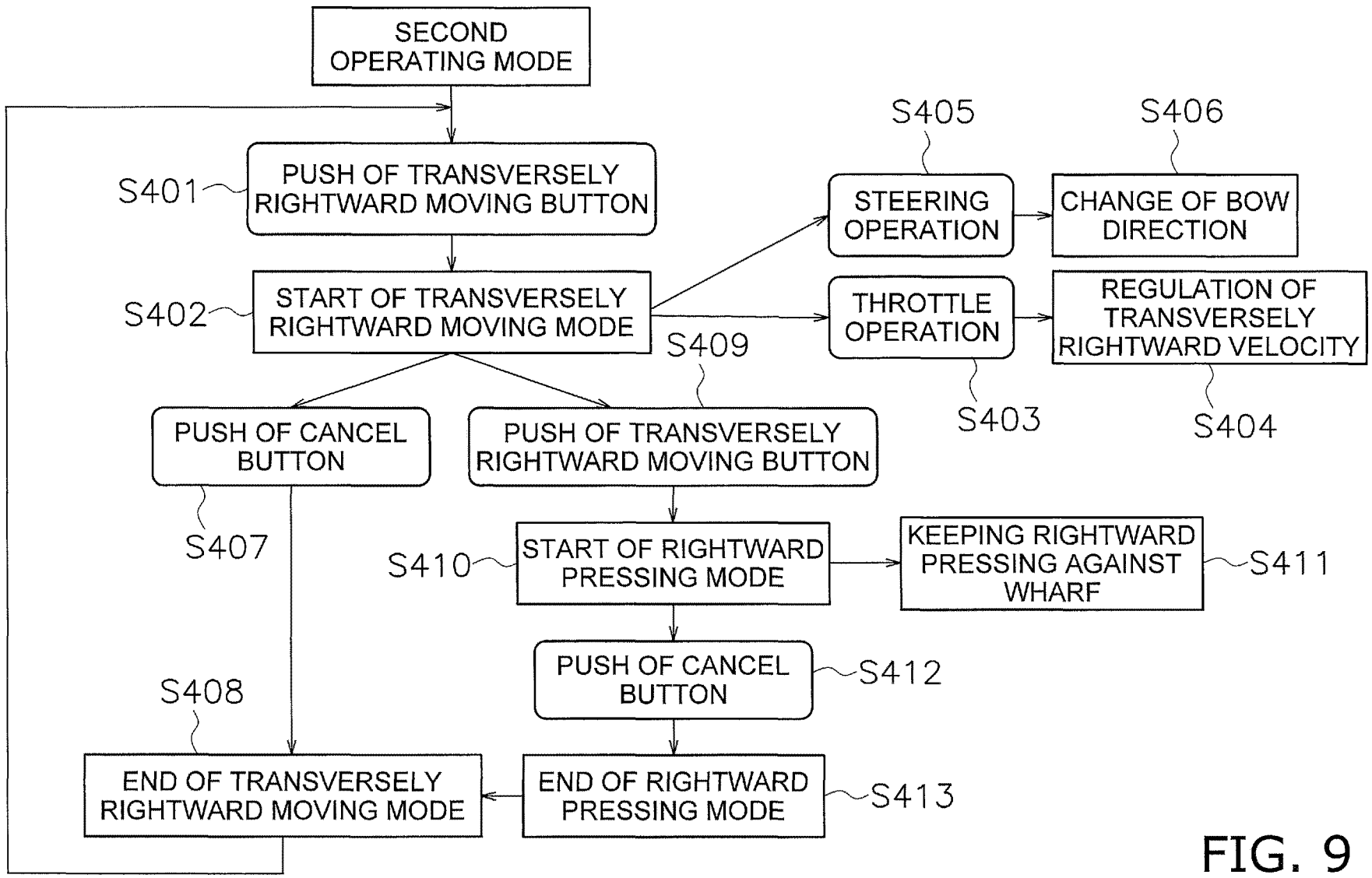
FIG. 9 is a diagram showing a flow of operations in a transversely rightward moving mode.

FIG. 9 is a diagram showing a flow of operations in the transversely rightward moving mode. As shown in FIG. 9, when the transversely rightward moving switch 54 is pushed (S401), the transversely rightward moving mode is started (S402). When the throttle operating member 56 is operated during the transversely rightward moving mode (S403), the controller 40 controls the engine rotational speed of each engine 3L, 3R in accordance with the operating amount of the throttle operating member 56. Therefore, the vessel operator is able to regulate the transversely rightward velocity of the vessel body 2 by operating the throttle operating member 56 during the transversely rightward moving mode (S404). Alternatively, the controller 40 may reduce the transversely rightward velocity of the vessel body 2 in response to pushing the transversely leftward moving switch 53 during the transversely rightward moving mode.

It should be noted that when the steering wheel 41 is operated during transversely rightward movement (S405), the controller 40 outputs a command signal to each steering actuator 32L, 32R so as to change the bow direction to the right and left in response to the operation of the steering wheel 41 (S406). Therefore, the vessel operator is able to turn the bow of the vessel body 2 to the right and left by operating the steering wheel 41 during the transversely rightward moving mode. When the cancel switch 59 is pushed during the transversely rightward moving mode (S407), the transversely rightward moving mode is terminated and the vessel body 2 stops (S408).

When the transversely rightward moving switch 54 is pushed during transversely rightward movement (S409), a rightward pressing mode is started (S401). In the rightward pressing mode, the controller 40 controls each marine propulsion device 4L, 4R so as to maintain a state that the vessel body 2 is pressed rightward against a place for docking (S411). More specifically, the controller 40 outputs command signals to each engine 3L, 3R and each steering actuator 32L, 32R so as to maintain a rightward thrust. When the cancel switch 59 is pushed during the rightward pressing mode (S412), the rightward pressing mode is terminated (S413).

It should be noted that the rightward pressing mode may be started when the transversely rightward moving switch 54 is pushed and held during transversely rightward movement. In other words, the rightward pressing mode may be started when the transversely rightward moving switch 54 is kept pushed for a predetermined period of time or greater (e.g., about several seconds) during transversely rightward movement.

Figure 10:
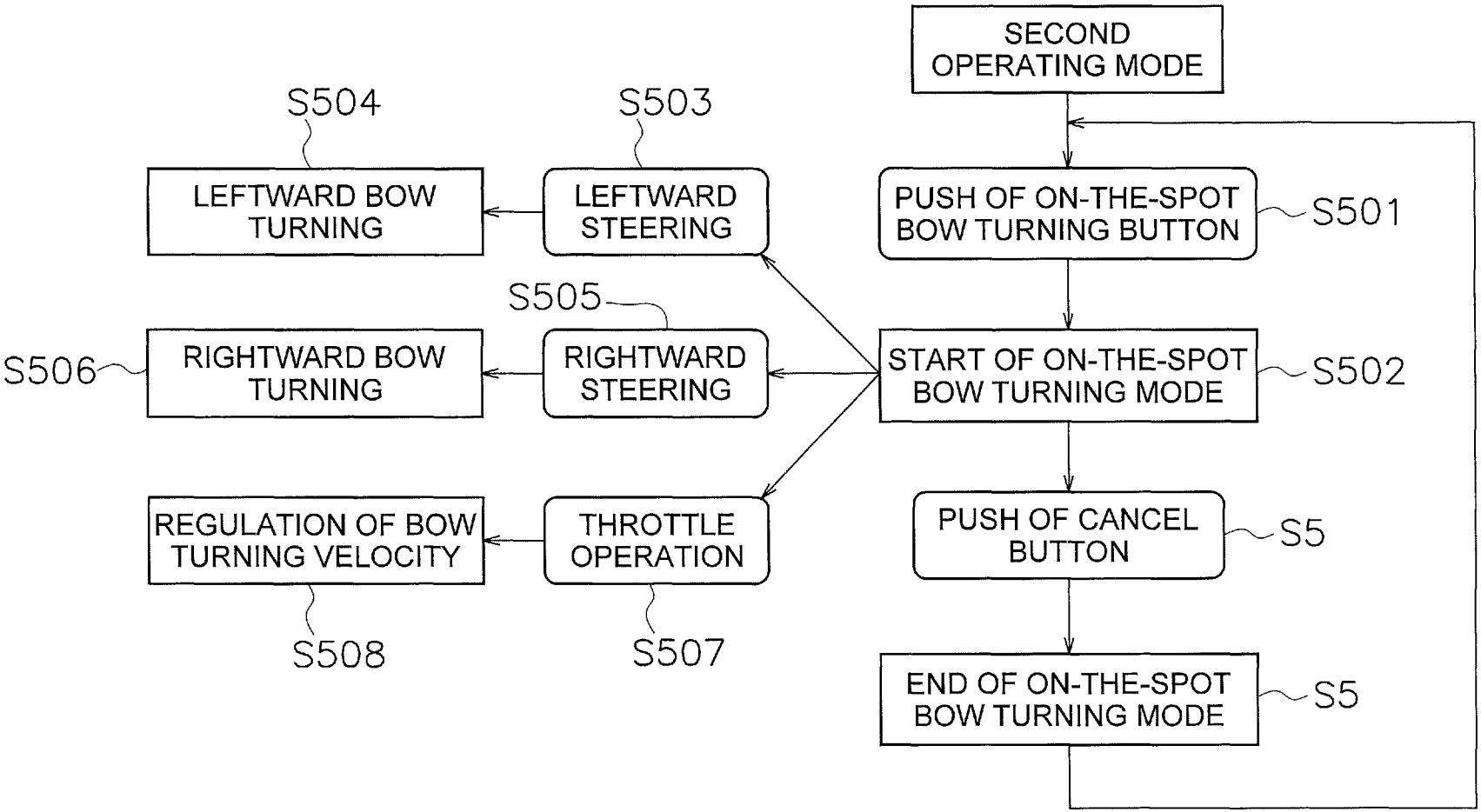
FIG. 10 is a diagram showing a flow of operations in an on-the-spot bow turning mode.

FIG. 10 is a diagram showing a flow of operations in the on-the-spot bow turning mode. As shown in FIG. 10, when the on-the-spot bow turning switch 55 is pushed (S501), the on-the-spot bow turning mode is started (S502). When the steering wheel 41 is operated during the on-the-spot bow turning mode, the controller 40 controls each marine propulsion device 4L, 4R so as to turn the bow of the vessel body 2 on the spot in a direction corresponding to the operating direction of the steering wheel 41.

More specifically, when the steering wheel 41 is turned to a position leftward of the middle position (S503), the controller 40 controls each marine propulsion device 4L, 4R so as to turn the bow of the vessel body 2 leftward on the spot (S504). For example, the controller 40 outputs command signals to the both steering actuators 32L and 32R, respectively, so as to move the first reverse bucket 26L to the backward moving position and move the second reverse bucket 26R to the forward moving position.

When the steering wheel 41 is turned to a position rightward of the middle position (S505), the controller 40 controls each marine propulsion device 4L, 4R so as to turn the bow of the vessel body 2 rightward on the spot (S506). For example, the controller 40 outputs command signals to the both steering actuators 32L and 32R, respectively, so as to move the second reverse bucket 26R to the backward moving position and move the first reverse bucket 26L to the forward moving position.

It should be noted that in the on-the-spot bow turning mode, the steering wheel 41 is provided with a dead range ranging rightward and leftward at a predetermined angle from the neutral position. In other words, even when the steering wheel 41 is turned right and left, bow turning is not executed if the steering wheel 41 is within the dead range. For example, where the maximum turning angle in steering is about 270 degrees, for example, the dead range may range rightward and leftward at an angle of about ±10 degrees, for example, from the middle position. It should be noted that the values of the maximum turning angle and the dead range are not limited to the above, and may be changed.

When the throttle operating member 56 is operated during the on-the-spot bow turning mode (S507), the controller 40 controls the engine rotational speed of each engine 3L, 3R in accordance with the operating amount of the throttle operating member 56. Therefore, the vessel operator is able to regulate the bow turning velocity of the vessel body 2 by operating the throttle operating member 56 during the on-the-spot bow turning mode (S508).

Alternatively, the controller 40 may regulate the bow turning velocity of the vessel body 2 in accordance with the operating amount of the steering wheel 41. In other words, the controller 40 may increase the leftward bow turning velocity of the vessel body 2 with an increase in the leftward steering angle of the steering wheel 41. The controller 40 may increase the rightward bow turning velocity of the vessel body 2 with an increase in the rightward steering angle of the steering wheel 41.

In the vessel body 2 according to the present preferred embodiment explained above, the vessel body 2 is able to be transversely moved by operating the transversely leftward moving switch 53 and the transversely rightward moving switch 54. Additionally, the transversely leftward moving switch 53 and the transversely rightward moving switch 54 are preferably attached to the steering wheel 41. Therefore, the vessel operator is able to operate the transversely leftward moving switch 53 and the transversely rightward moving switch 54 without releasing his/her hands away from the steering wheel 41. Therefore, an operation of transverse movement is easily performed for the vessel body 2.

Additionally, the throttle operating member 56 is preferably attached to the steering wheel 41. Therefore, the vessel operator is able to regulate the engine rotational speed of each engine 3L, 3R without releasing his/her hands away from the steering wheel 41. The vessel operator is able to easily regulate the velocity of the vessel body 2 by operating the throttle operating member 56 while holding the steering wheel 41.

The forward moving switch 51 and the backward moving switch 52 are preferably attached to the steering wheel 41. Therefore, the vessel operator is able to operate the forward moving switch 51 and the backward moving switch 52 without releasing his/her hands away from the steering wheel 41. Therefore, operations for forward movement and backward movement are easily performed for the vessel body 2.

The on-the-spot bow turning switch 55 is preferably attached to the steering wheel 41. Therefore, the vessel operator is able to operate the on-the-spot bow turning switch 55 without releasing his/her hands away from the steering wheel 41. Additionally, the direction of on-the-spot bow turning is operated by the steering wheel 41. Therefore, an operation of on-the-spot bow turning is easily performed for the vessel body 2.

The pressing modes are able to be started by operating the transversely leftward moving switch 53 and the transversely rightward moving switch 54. Especially, the leftward pressing mode may be started by operating the transversely leftward moving switch 53 during the transversely leftward moving mode. Therefore, the leftward pressing mode is easily started consecutively after transversely leftward movement. Alternatively, the rightward pressing mode may be started by operating the transversely rightward moving switch 54 during the transversely rightward moving mode. Therefore, the rightward pressing mode is easily started consecutively after transversely rightward movement.

The throttle operating member 56 includes the left lever 57 and the right lever 58. Therefore, even in a state that the steering wheel 41 is greatly rotated from the middle position, the throttle operating member 56 is easily operated by operating either the left lever 57 or the right lever 58.

Figure 11:
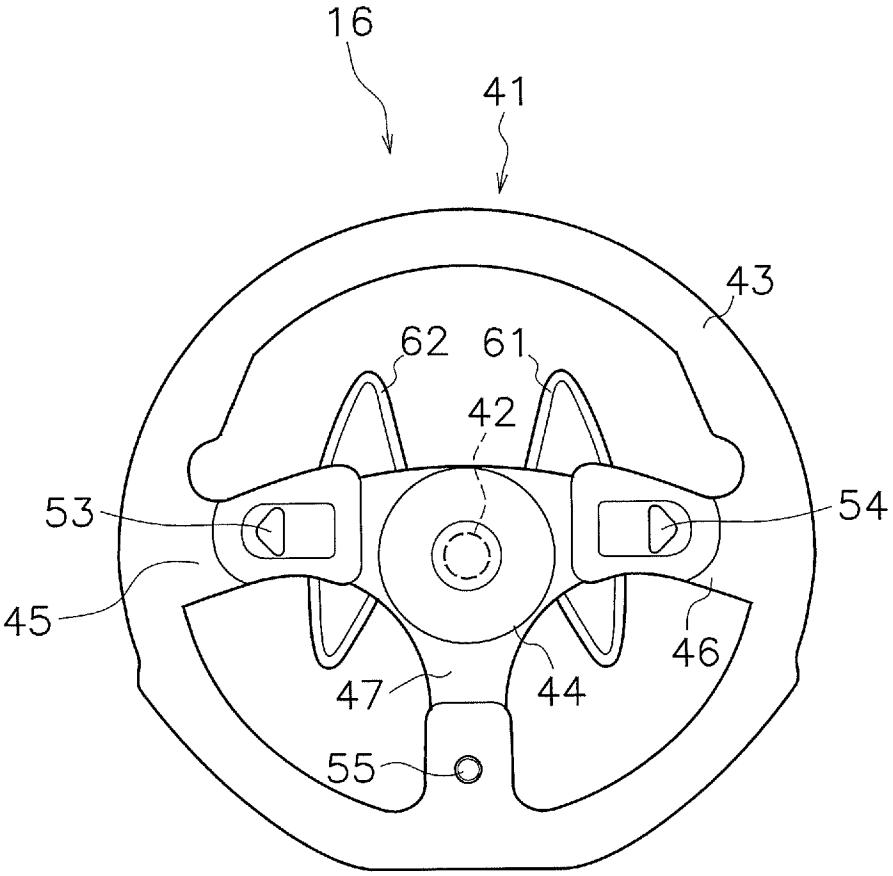
FIG. 11 is a diagram showing a steering device according to a second preferred embodiment of the present invention.

Next, a steering device 16 according to a second preferred embodiment will be explained. FIG. 11 is a diagram showing the steering device 16 according to the second preferred embodiment. As shown in FIG. 11, in the steering device 16 according to the second preferred embodiment, the transversely leftward moving switch 53 is located leftward of the steering shaft 42. The transversely rightward moving switch 54 is disposed rightward of the steering shaft 42. More specifically, the transversely leftward moving switch 53 is disposed on the left spoke 45. The transversely rightward moving switch 54 is disposed on the right spoke 46. The transversely leftward moving mode, which is executed by the transversely leftward moving switch 53, and the transversely rightward moving mode, which is executed by the transversely rightward moving switch 54, are similar to those in the first preferred embodiment, and hence, explanation thereof will be omitted.

Similarly to the steering device 14 according to the first preferred embodiment, the steering device 16 according to the second preferred embodiment is provided with the on-the-spot bow turning switch 55. The on-the-spot bow turning mode, which is started by the on-the-spot bow turning switch 55, is similar to that in the first preferred embodiment, and hence, explanation thereof will be omitted.

In the steering device 14 according to the first preferred embodiment, forward movement and backward movement of the vessel body 2 are operated by the forward moving switch 51 and the backward moving switch 52, respectively. However, as with the steering device 16 according to the second preferred embodiment, the forward moving switch 51 and the backward moving switch 52 may be omitted.

The steering device 16 according to the second preferred embodiment includes a first throttle operating member 61 and a second throttle operating member 62. The first and second throttle operating members 61 and 62 are attached to the steering wheel 41. Each of the first and second throttle operating members 61 and 62 preferably has the shape of a lever. Each of the first and second throttle operating members 61 and 62 is operable to an arbitrary position between a zero operating position and a maximum operating position.

The controller 40 controls a forward moving directional thrust applied from each marine propulsion device 4L, 4R in accordance with the operating amount of the first throttle operating member 61. The controller 40 controls a backward moving directional thrust applied from each marine propulsion device 4L, 4R in accordance with the operating amount of the second throttle operating member 62.

The first throttle operating member 61 is disposed on one side of the steering shaft 42 in the right-and-left direction. The second throttle operating member 62 is disposed on the other side of the steering shaft 42 in the right-and-left direction. More specifically, the first throttle operating member 61 is disposed leftward of the steering shaft 42. The second throttle operating member 62 is disposed rightward of the steering shaft 42. It should be noted that the first and second throttle operating members 61 and 62 may have a different layout.

Figure 12:
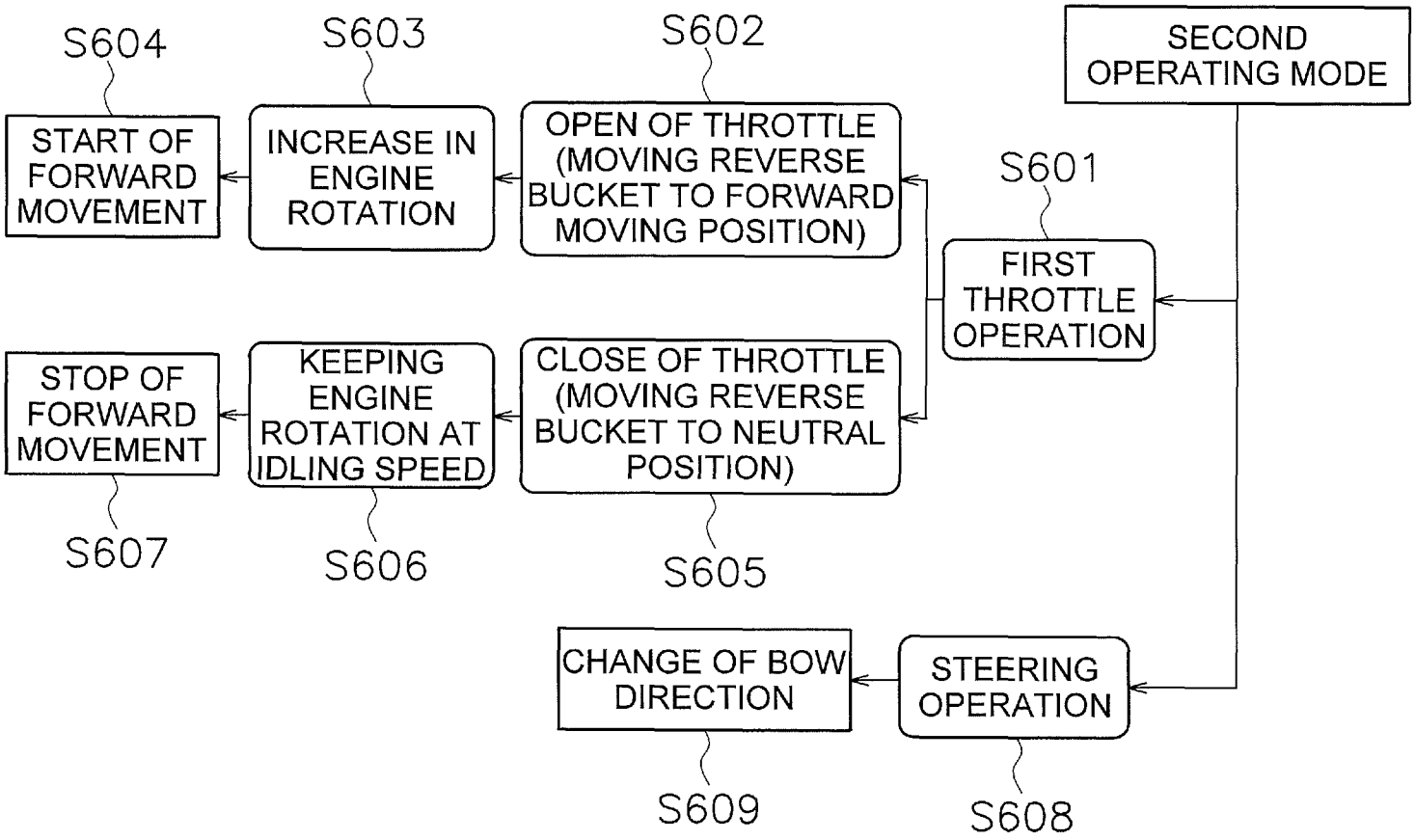
FIG. 12 is a diagram showing a flow of operations when operating a first throttle operating member.

FIG. 12 is a diagram showing a flow of operations when operating the first throttle operating member 61. As shown in FIG. 12, when the first throttle operating member 61 is operated (S601), the controller 40 controls each marine propulsion device 4L, 4R in response to the operation of the first throttle operating member 61. More specifically, when the vessel operator opens the first throttle operating member 61, the controller 40 moves each reverse bucket 26L, 26R from the neutral position to the forward moving position (S602). Additionally, the controller 40 increases the engine rotational speed of each engine 3L, 3R (S603). The vessel body 2 thus starts moving forward (S604).

During forward movement of the vessel body 2, the controller 40 controls the engine rotational speed of each engine 3L, 3R in accordance with the operating amount of the first throttle operating member 61. Therefore, the vessel operator is able to regulate the forward velocity of the vessel body 2 by operating the first throttle operating member 61 during the forward moving mode.

When the vessel operator closes the first throttle operating member 61, the controller 40 moves each reverse bucket 26L, 26R from the forward moving position to the neutral position (S605). Additionally, the controller 40 maintains the engine rotational speed of each engine 3L, 3R at the idling rotational speed (S606). The vessel body 2 thus stops moving forward (S607).

It should be noted that when the steering wheel 41 is operated during forward movement (S608), the controller 40 outputs a command signal to each steering actuator 32L, 32R so as to change the bow direction to the right and left in response to the operation of the steering wheel 41 (S609). The vessel body 2 thus turns the bow thereof to the right and left, while moving forward.

Figure 13:
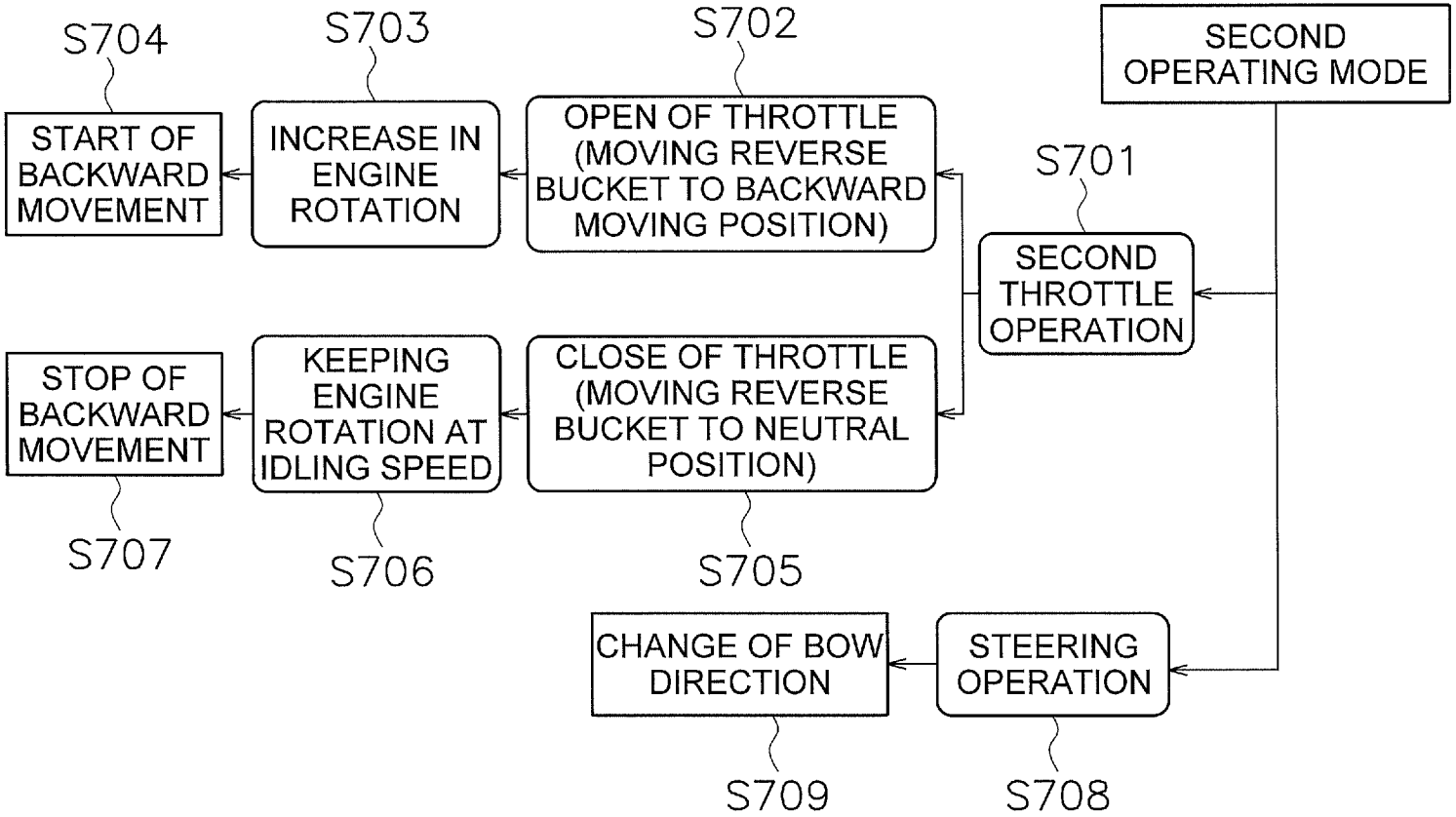
FIG. 13 is a diagram showing a flow of operations when operating a second throttle operating member.

FIG. 13 is a diagram showing a flow of operations when operating the second throttle operating member 62. As shown in FIG. 13, when the second throttle operating member 62 is operated (S701), the controller 40 controls each marine propulsion device 4L, 4R in response to the operation of the second throttle operating member 62. More specifically, when the vessel operator opens the second throttle operating member 62, the controller 40 moves each reverse bucket 26L, 26R from the neutral position to the backward moving position (S702). Additionally, the controller 40 increases the engine rotational speed of each engine 3L, 3R (S703). The vessel body 2 thus starts moving backward (S704).

During backward movement of the vessel body 2, the controller 40 controls the engine rotational speed of each engine 3L, 3R in accordance with the operating amount of the second throttle operating member 62. Therefore, the vessel operator is able to regulate the backward velocity of the vessel body 2 by operating the second throttle operating member 62 during the backward moving mode.

When the vessel operator closes the second throttle operating member 62, the controller 40 moves each reverse bucket 26L, 26R from the backward moving position to the neutral position (S705). Additionally, the controller 40 maintains the engine rotational speed of each engine 3L, 3R at the idling rotational speed (S706). The vessel body 2 thus stops moving backward (S707).

It should be noted that when the steering wheel 41 is operated during backward movement (S708), the controller 40 outputs a command signal to each steering actuator 32L, 32R so as to change the bow direction to the right and left in response to the operation of the steering wheel 41 (S709). The vessel body 2 thus turns the bow thereof to the right and left, while moving backward.

In the steering device 14 according to the first preferred embodiment, each moving mode is terminated in response to pushing the cancel switch 59. However, the cancel switch 59 may be omitted as with the steering device 16 according to the second preferred embodiment.

In the steering device 16 according to the second preferred embodiment, the controller 40 may terminate the transversely leftward moving mode in response to pushing the transversely leftward moving switch 53 during the transversely leftward moving mode. Alternatively, the controller 40 may terminate the transversely leftward moving mode in response to pushing another moving switch different from the transversely leftward moving switch 53 during the transversely leftward moving mode.

The controller 40 may terminate the transversely rightward moving mode in response to pushing the transversely rightward moving switch 54 during the transversely rightward moving mode. Alternatively, the controller 40 may terminate the transversely rightward moving mode in response to pushing another moving switch different from the transversely rightward moving switch 54 during the transversely rightward moving mode.

The controller 40 may terminate the on-the-spot bow turning mode in response to pushing the on-the-spot bow turning switch 55 during the on-the-spot bow turning mode. Alternatively, the controller 40 may terminate the on-the-spot bow turning mode in response to pushing another moving switch different from the on-the-spot bow turning switch 55 during the on-the-spot bow turning mode.

Alternatively, the controller 40 may terminate the transversely leftward moving mode, the transversely rightward moving mode, or the on-the-spot bow turning mode in response to operating the plurality of moving switches 50 to 56 in combination.

Preferred embodiments of the present invention have been explained above. However, the present invention is not limited to the preferred embodiments described above, and a variety of changes can be made without departing from the gist of the present invention.

The moving switches 50 to 56 or the cancel switch 59 may have a different layout. For example, the location at which the four directional key 50 is disposed is not limited to the left spoke 45, and may be another location. The location at which the on-the-spot bow turning switch 55 is disposed is not limited to the down spoke 47, and may be another location. The steering wheel 41 may be changed in shape. For example, the steering wheel 41 may have a shape different from an annular shape. The four directional key 50 is not limited to a key that indicates the four directions of up, down, right and left, and alternatively, may be a key that indicates eight directions including not only the above four directions but also oblique 45-degree directions.

The controller 40 may start the forward moving mode in response to pushing and holding the forward moving switch 51. The controller 40 may start the backward moving mode in response to pushing and holding the backward moving switch 52. The controller 40 may start the transversely leftward moving mode in response to pushing and holding the transversely leftward moving switch 53. The controller 40 may start the transversely rightward moving mode in response to pushing and holding the transversely rightward moving switch 54. The controller 40 may start the on-the-spot bow turning mode in response to pushing and holding the on-the-spot bow turning switch 55.

In the steering device 14 according to the first preferred embodiment, the controller 40 may stop the forward moving mode in response to pushing the forward moving switch 51 during the forward moving mode. Alternatively, the controller 40 may stop the forward moving mode in response to pushing another moving switch different from the forward moving switch 51 during the forward moving mode.

The controller 40 may stop the backward moving mode in response to pushing the backward moving switch 52 during the backward moving mode. Alternatively, the controller 40 may stop the backward moving mode in response to pushing another moving switch different from the backward moving switch 52 during the backward moving mode.

Pilot lamps, each of which indicates that each moving mode is ongoing, may be disposed on the steering wheel 41.

Figure 14:
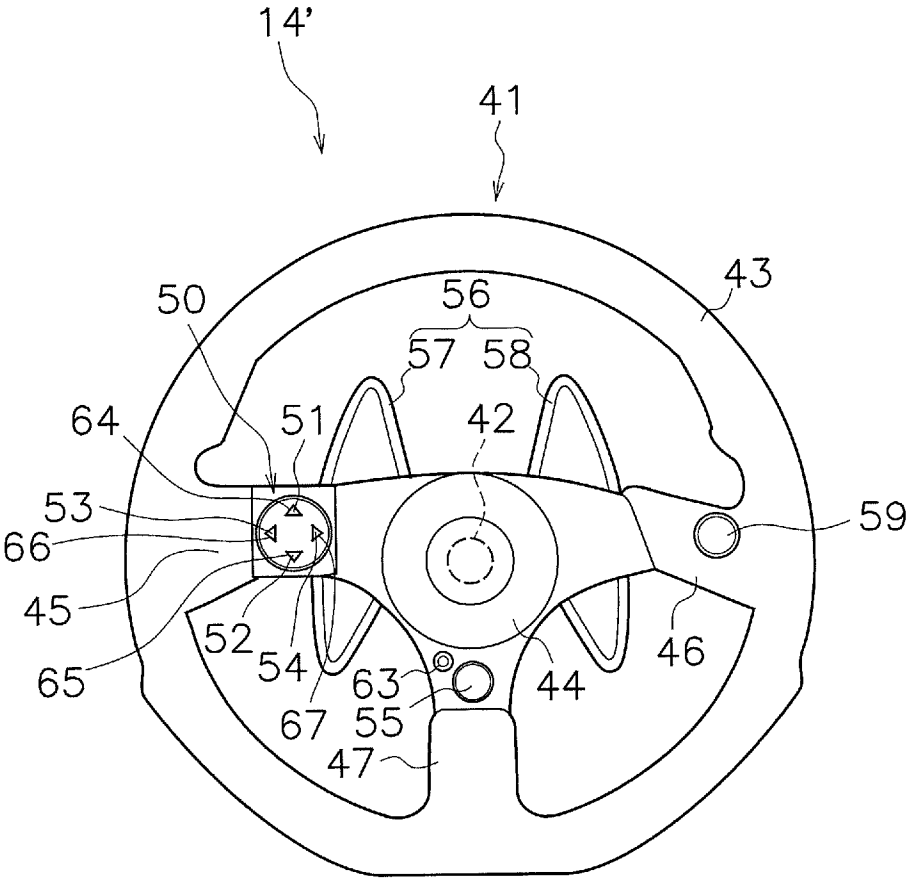
FIG. 14 is a diagram showing a steering device according to a modification of the first preferred embodiment of the present invention.

For example, FIG. 14 shows a steering device 14' according to a modification of the first preferred embodiment. As shown in FIG. 14, a pilot lamp 63, indicating that the on-the-spot bow turning mode is ongoing, may be disposed on the steering wheel 41. The pilot lamp 63, indicating that the on-the-spot bow turning mode is ongoing, may be disposed in the vicinity of the on-the-spot bow turning switch 55. For example, the pilot lamp 63, indicating that the on-the-spot bow turning mode is ongoing, may be disposed on the down spoke 47.

A pilot lamp 64, indicating that the forward moving mode is ongoing, may be disposed on the steering wheel 41. The pilot lamp 64, indicating that the forward moving mode is ongoing, may be disposed on the forward moving switch 51. A pilot lamp 65, indicating that the backward moving mode is ongoing, may be disposed on the steering wheel 41. The pilot lamp 65, indicating that the backward moving mode is ongoing, may be disposed on the backward moving switch 52.

A pilot lamp 66, indicating that the transversely leftward moving mode is ongoing, may be disposed on the steering wheel 41. The pilot lamp 66, indicating that the transversely leftward moving mode is ongoing, may be disposed on the transversely leftward moving switch 53.

A pilot lamp 67, indicating that the transversely rightward moving mode is ongoing, may be disposed on the steering wheel 41. The pilot lamp 67, indicating that the transversely rightward moving mode is ongoing, may be disposed on the transversely rightward moving switch 54.

Figure 15:
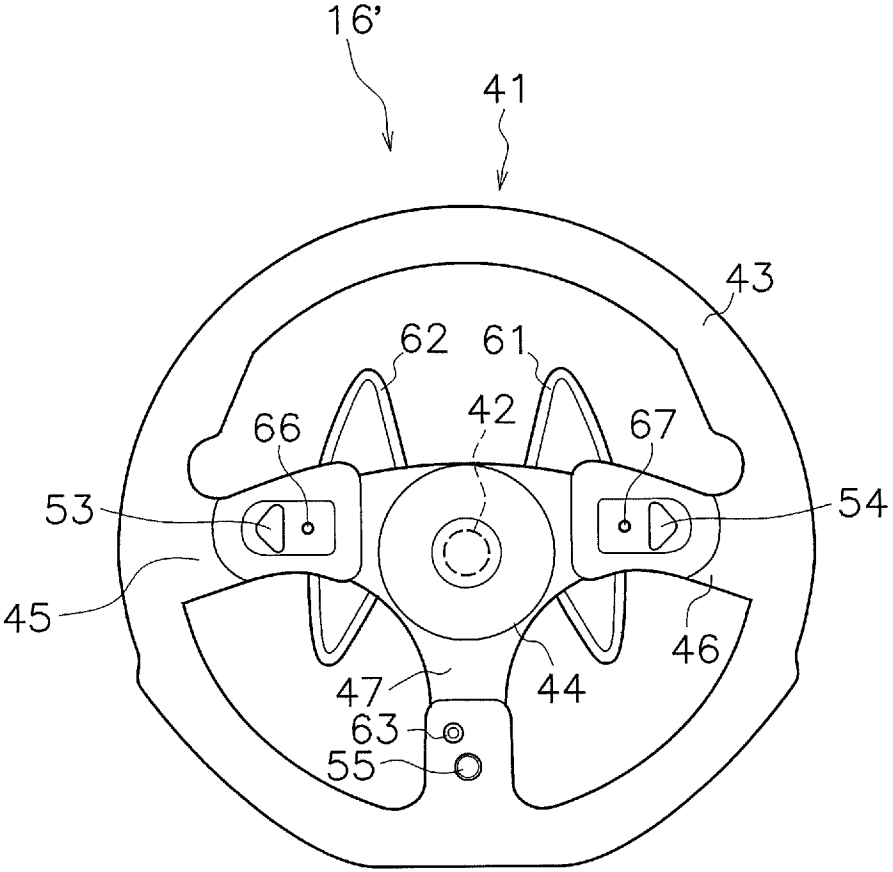
FIG. 15 is a diagram showing a steering device according to a modification of the second preferred embodiment of the present invention.

FIG. 15 is a diagram showing a steering device 16' according to a modification of the second preferred embodiment. As shown in FIG. 15, the pilot lamp 66, indicating that the transversely leftward moving mode is ongoing, may be disposed in the vicinity of the transversely leftward moving switch 53. The pilot lamp 66, indicating that the transversely leftward moving mode is ongoing, may be disposed on the left spoke 45.

The pilot lamp 67, indicating that the transversely rightward moving mode is ongoing, may be disposed in the vicinity of the transversely rightward moving switch 54. The pilot lamp 67, indicating that the transversely rightward moving mode is ongoing, may be disposed on the right spoke 46.

It should be noted that the pilot lamps 63 to 67 may be disposed in positions different from those described above. One or all of the pilot lamps 63 to 67 may be omitted. A method of confirming whether or not each moving mode is ongoing may be executed with a single or combination of each pilot lamp, a sound, and a display of a character or characters, for example.

The operating mode selector switch 60 may be omitted. In this case, the first operating mode may be switched to the second operating mode in response to pushing any one of the plurality of moving switches 50 to 56. Alternatively, the first operating mode may be switched to the second operating mode in response to pushing the plurality of moving switches 50 to 56 in combination. The second operating mode may be switched to the first operating mode in response to operating the throttle operating member 56, the first throttle operating member 61, or the second throttle operating member 62.

The throttle operating member 56 may be disposed at a location other than the steering device 14. The throttle operating member 56 may be omitted. For example, the controller 40 may control each marine propulsion device 4L, 4R so as to move the vessel body 2 at a predetermined velocity in response to pushing the transversely leftward moving switch 53 or the transversely rightward moving switch 54. The on-the-spot bow turning switch 55 may be disposed at a location other than the steering device 14. The on-the-spot bow turning switch 55 may be omitted.

The first and second throttle operating members 61 and 62 may be disposed at a location or locations other than the steering device 14. The first and second throttle operating members 61 and 62 may be omitted. For example, the controller 40 may control each marine propulsion device 4L, 4R so as to move the vessel body 2 at a predetermined velocity in response to pushing the transversely leftward moving switch 53 or the transversely rightward moving switch 54. The controller 40 may control each marine propulsion device 4L, 4R so as to move the vessel body 2 at a predetermined velocity in response to pushing the forward moving switch 51 or the backward moving switch 52.

The forward moving switch 51, the backward moving switch 52, the transversely leftward moving switch 53, the transversely rightward moving switch 54, the on-the-spot bow turning switch 55, or the cancel switch 59 is not limited to a push-button switch, and alternatively, may be another type of switch. For example, the forward moving switch 51, the backward moving switch 52, the transversely leftward moving switch 53, the transversely rightward moving switch 54, the on-the-spot bow turning switch 55, or the cancel switch 59 may be a slide switch, a rotary switch, a toggle switch or so forth.

A current moving mode may be changed to an intended moving mode by pushing a switch corresponding to the intended moving mode without pushing the cancel switch 59. In other words, the current moving mode is able to directly transition to the intended moving mode by pushing the switch corresponding to the intended moving mode during execution of the current moving mode.

The throttle operating member 56, the first throttle operating member 61, or the second throttle operating member 62 is not limited to the shape of a lever. For example, the throttle operating member 56, the first throttle operating member 61, or the second throttle operating member 62 may be a push-button switch, a slide switch, a rotary switch, a toggle switch or so forth. Additionally, the engine rotational speed may be increased or decreased by a predetermined value every time the throttle operating member 56, the first throttle operating member 61, or the second throttle operating member 62 is operated.

Figure 16:
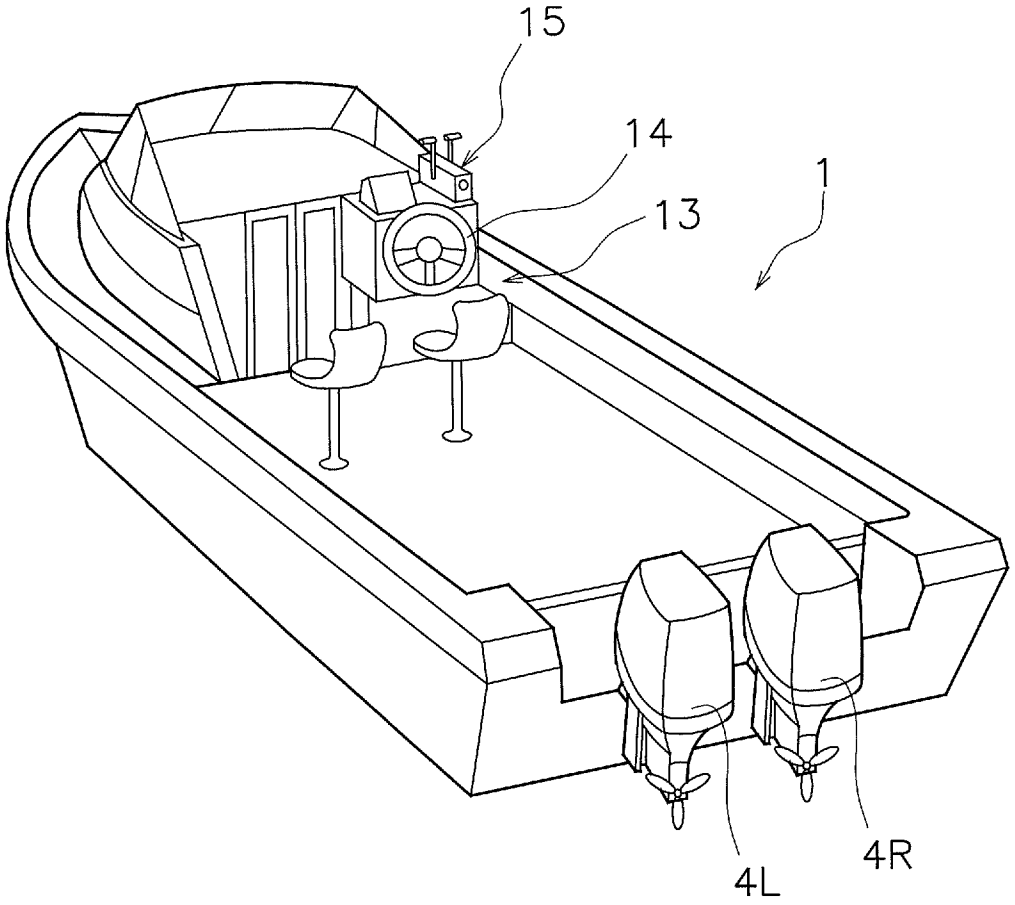
FIG. 16 is a perspective view of a watercraft according to another preferred embodiment of the present invention.

The watercraft 1 is not limited to a jet propulsion watercraft, and alternatively, may be another type of watercraft. For example, as shown in FIG. 16, the watercraft 1 may of the type including outboard motors as the marine propulsion devices 4L and 4R. In other words, the marine propulsion devices 4L and 4R are not limited to jet propulsion devices, and alternatively, may be another type of marine propulsion device such as an outboard motor.

Figure 17:
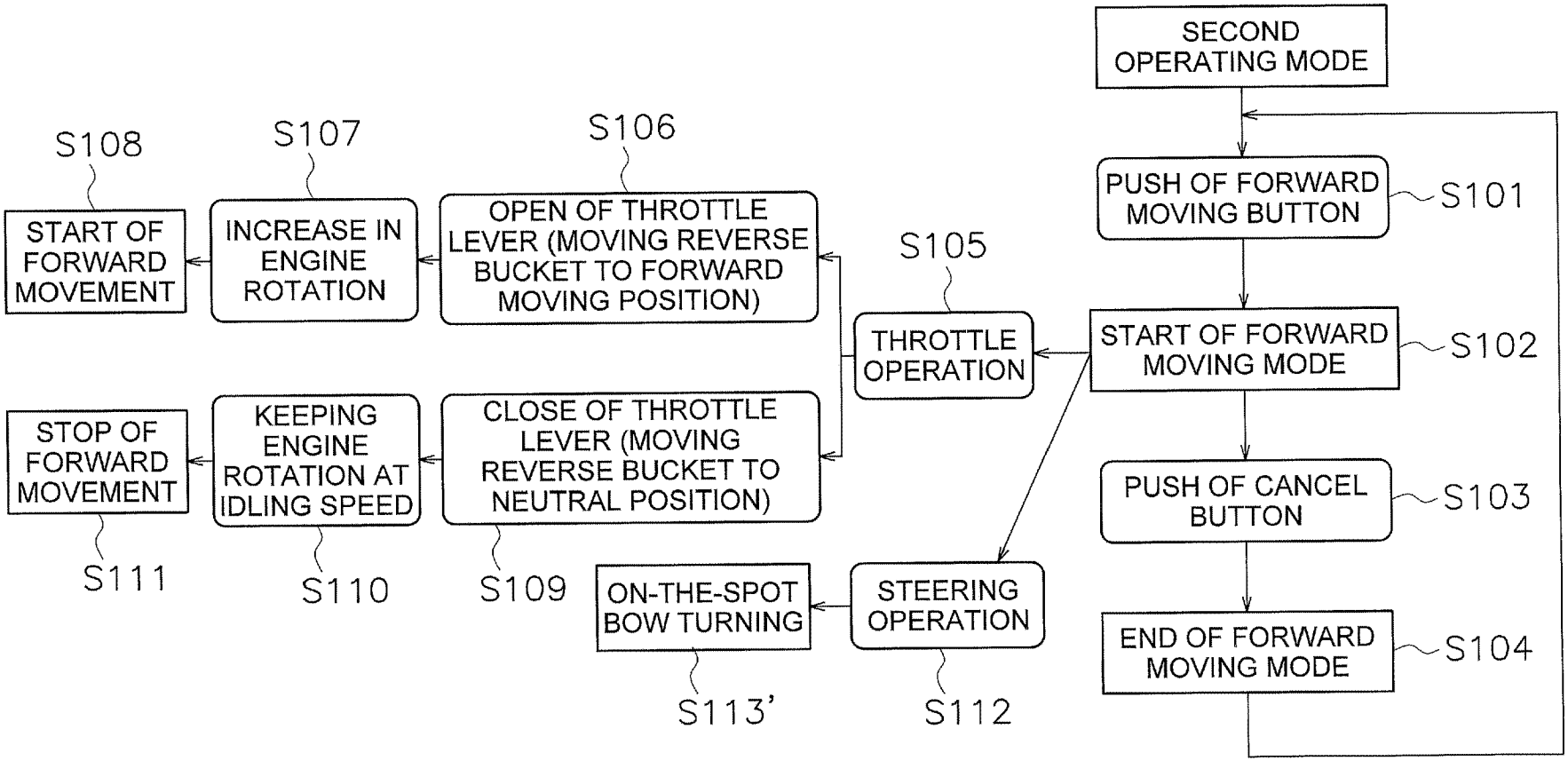
FIG. 17 is a diagram showing a flow of operations in the forward moving mode according to the modification of the first preferred embodiment of the present invention.

FIG. 17 is a diagram showing a flow of operations in the forward moving mode according to the modification of the first preferred embodiment. In the forward moving mode according to the modification of the first preferred embodiment, when the steering wheel 41 is operated (S112), the controller 40 controls each marine propulsion device 4L, 4R so as to turn the bow of the vessel body 2 on the spot in a direction corresponding to the operating direction of the steering wheel 41 (S113'). For example, when the steering wheel 41 is turned rightward or leftward and the steering angle exceeds a predetermined threshold, the controller 40 turns the bow of the vessel body 2 on the spot in the direction corresponding to the operating direction of the steering wheel 41. The predetermined threshold may be, for instance, 45 degrees. It should be noted that the predetermined threshold is not limited to 45 degrees, and alternatively, may be another value.

It should be noted that the bow turning velocity may be changed in accordance with the steering angle. Additionally, even during on-the-spot bow turning, when the throttle operating member 56 is operated, priority may be given to regulation of the bow turning velocity by the throttle operating member 56. Moreover, similarly in the backward moving mode in the first preferred embodiment, the controller 40 may control each marine propulsion device 4L, 4R so as to turn the bow of the vessel body 2 on the spot in a direction corresponding to the operating direction of the steering wheel 41. It should be noted that the other processes are similar to those in the first preferred embodiment. Hence, explanation thereof will be omitted.

Figure 18:
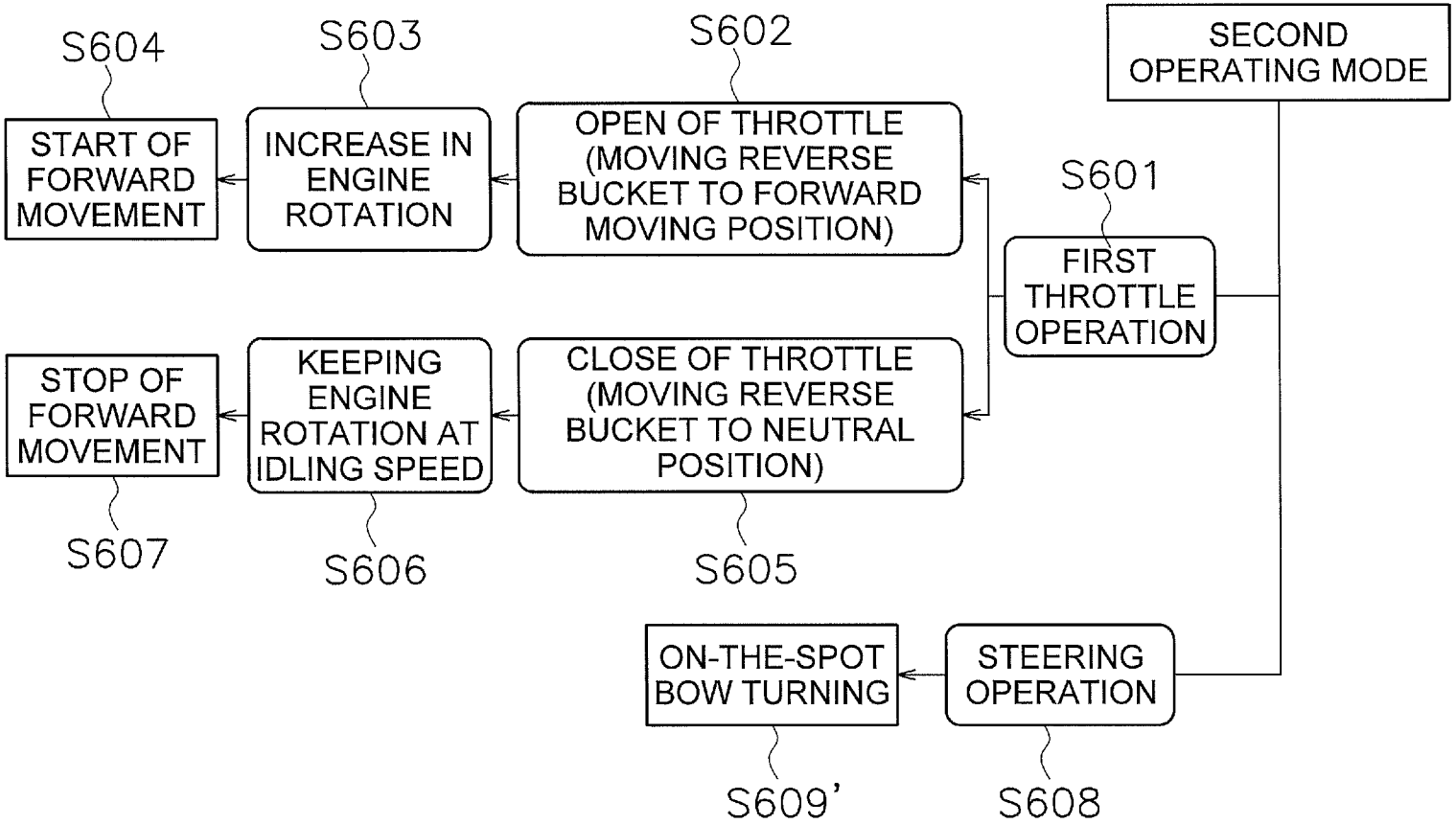
FIG. 18 is a diagram showing a flow of operations when operating the first throttle operating member according to the modification of the second preferred embodiment of the present invention.

FIG. 18 is a diagram showing a flow of operations when operating the first throttle operating member 61 according to the modification of the second preferred embodiment. In the modification of the second preferred embodiment, similarly to the modification of the first preferred embodiment, when the steering wheel 41 is operated (S608), the controller 40 may control each marine propulsion device 4L, 4R so as to turn the bow of the vessel body 2 on the spot in a direction corresponding to the operating direction of the steering wheel 41 (S609'). Additionally, similarly when the second throttle operating member 62 is operated, the controller 40 may control each marine propulsion device 4L, 4R so as to turn the bow of the vessel body 2 on the spot in a direction corresponding to the operating direction of the steering wheel 41. It should be noted that the other processes are similar to those in the second preferred embodiment. Hence, explanation thereof will be omitted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft comprising:

a vessel body;

a marine propulsion device attached to the vessel body;

a steering wheel attached to the vessel body so as to be rotatable about a steering shaft;

a transversely leftward moving switch attached to the steering wheel;

a transversely rightward moving switch attached to the steering wheel; and a controller configured or programmed to control the marine propulsion device so as to move the vessel body transversely leftward when the transversely leftward moving switch is operated, and to control the marine propulsion device so as to move the vessel body transversely rightward when the transversely rightward moving switch is operated; wherein the transversely leftward moving switch is disposed leftward of the steering shaft; and the transversely rightward moving switch is disposed rightward of the steering shaft.

2. The watercraft according to claim 1, further comprising a throttle operating member including a throttle operating lever or a throttle operating switch; wherein the controller is further configured or programmed to:

set a control mode of the marine propulsion device to a transversely leftward moving mode when the transversely leftward moving switch is operated;

control the marine propulsion device so as to regulate a transversely leftward velocity of the vessel body in accordance with an operating amount of the throttle operating member when the throttle operating member is operated during the transversely leftward moving mode;

set the control mode to a transversely rightward moving mode when the transversely rightward moving switch is operated; and control the marine propulsion device so as to regulate a transversely rightward velocity of the vessel body in accordance with the operating amount of the throttle operating member when the throttle operating member is operated during the transversely rightward moving mode.

3. The watercraft according to claim 2, wherein the controller is further configured or programmed to:

set the control mode to a leftward pressing mode when the transversely leftward moving switch is operated during the transversely leftward moving mode;

control the marine propulsion device so as to maintain a leftward thrust during the leftward pressing mode;

set the control mode to a rightward pressing mode when the transversely rightward moving switch is operated during the transversely rightward moving mode; and control the marine propulsion device so as to maintain a rightward thrust during the rightward pressing mode.

4. The watercraft according to claim 1, further comprising:

an on-the-spot bow turning switch attached to the steering wheel; wherein the marine propulsion device includes a first marine propulsion device and a second marine propulsion device;

the first marine propulsion device includes a first nozzle and a first reverse bucket;

the second marine propulsion device includes a second nozzle and a second reverse bucket; and when the on-the-spot bow turning switch is operated, the controller is configured or programmed to control the first reverse bucket to move to a backward moving position and the second reverse bucket to move to a forward moving position so as to turn a bow of the vessel body on the spot.

5. The watercraft according to claim 4, wherein the controller is further configured or programmed to:

set a control mode of the marine propulsion device to an on-the-spot bow turning mode when the on-the-spot bow turning switch is operated; and control the marine propulsion device so as to turn the bow of the vessel body on the spot in a direction corresponding to an operating direction of the steering wheel when the steering wheel is operated during the on-the-spot bow turning mode.

6. The watercraft according to claim 1, further comprising:

a cancel switch attached to the steering wheel; wherein the marine propulsion device includes a first marine propulsion device and a second marine propulsion device;

the first marine propulsion device includes a first nozzle and a first reverse bucket;

the second marine propulsion device includes a second nozzle and a second reverse bucket; and when the cancel switch is operated, the controller is configured or programmed to move each of the first reverse bucket and the second reverse bucket to a neutral position so as to stop the vessel body.

7. The watercraft according to claim 1, further comprising:

a plurality of moving switches to move the vessel body, the plurality of moving switches being attached to the steering wheel; wherein the plurality of moving switches include the transversely leftward moving switch and the transversely rightward moving switch; and the controller is further configured or programmed to:

control the marine propulsion device so as to stop the vessel body when at least one of the plurality of moving switches is operated while the vessel body is being moved transversely leftward in response to operating the transversely leftward moving switch; and control the marine propulsion device so as to stop the vessel body when at least one of the plurality of moving switches is operated while the vessel body is being moved transversely rightward in response to operating the transversely rightward moving switch.

8. The watercraft according to claim 1, further comprising:

a throttle operating member attached to the steering wheel; wherein the throttle operating member includes a throttle operating lever or a throttle operating switch; and the controller is further configured or programmed to control a thrust applied from the marine propulsion device in accordance with an operating amount of the throttle operating member.

9. A watercraft comprising:

a vessel body;

a marine propulsion device attached to the vessel body;

a steering wheel attached to the vessel body so as to be rotatable about a steering shaft;

a controller; and a throttle operating member attached to the steering wheel, the throttle operating member including a left lever disposed leftward of the steering shaft and a right lever disposed rightward of the steering shaft; wherein the controller is configured or programmed to control a thrust applied from the marine propulsion device in accordance with an operating amount of the throttle operating member.

10. The watercraft according to claim 1, further comprising:

a four directional key attached to the steering wheel, the four directional key including front, back, right, and left directional keys; wherein the transversely leftward moving switch corresponds to the left directional key of the four directional key; and the transversely rightward moving switch corresponds to the right directional key of the four directional key.

11. The watercraft according to claim 10, wherein the controller is further configured or programmed to control the marine propulsion device so as to:

move the vessel body forward when the front directional key of the four directional key is pushed; and move the vessel body backward when the back directional key of the four directional key is pushed.

12. The watercraft according to claim 11, further comprising:

a throttle operating member attached to the steering wheel; wherein the throttle operating member includes a throttle operating lever or a throttle operating switch; and the controller is further configured or programmed to:

set a control mode of the marine propulsion device to a forward moving mode when the front directional key of the four directional key is pushed;

control the marine propulsion device so as to regulate a forward velocity of the vessel body in accordance with an operating amount of the throttle operating member when the throttle operating member is operated during the forward moving mode;

set the control mode of the marine propulsion device to a backward moving mode when the back directional key of the four directional key is pushed; and control the marine propulsion device so as to regulate a backward velocity of the vessel body in accordance with the operating amount of the throttle operating member when the throttle operating member is operated during the backward moving mode.

13. The watercraft according to claim 1, wherein the controller is further configured or programmed to control the marine propulsion device so as to turn a bow of the vessel body in a direction corresponding to an operating direction of the steering wheel while the vessel body is being moved transversely rightward or leftward.

14. The watercraft according to claim 1, wherein the controller is further configured or programmed to control the marine propulsion device so as to:

decelerate a transversely leftward velocity of the vessel body when the transversely rightward moving switch is operated while the vessel body is being moved transversely leftward; and decelerate a transversely rightward velocity of the vessel body when the transversely leftward moving switch is operated while the vessel body is being moved transversely rightward.

15. A watercraft comprising:

a vessel body;

a marine propulsion device attached to the vessel body;

a steering wheel attached to the vessel body so as to be rotatable about a steering shaft;

a controller;

a first throttle operating member including a throttle operating lever or a throttle operating switch, the first throttle operating member being attached to the steering wheel; and a second throttle operating member including a throttle operating lever or a throttle operating switch, the second throttle operating member being attached to the steering wheel; wherein the controller is further configured or programmed to:

control a forward moving directional thrust applied from the marine propulsion device in accordance with an operating amount of the first throttle operating member; and control a backward moving directional thrust applied from the marine propulsion device in accordance with an operating amount of the second throttle operating member;

the first throttle operating member is disposed on one side of the steering shaft in a right-and-left direction; and the second throttle operating member is disposed on another side, opposite to the one side, of the steering shaft in the right-and-left direction.

16. The watercraft according to claim 1, further comprising:

a throttle operating member attached to the steering wheel; wherein the throttle operating member includes a throttle operating lever or a throttle operating switch;

the marine propulsion device includes a first marine propulsion device and a second marine propulsion device;

the first marine propulsion device includes a first nozzle and a first reverse bucket;

the second marine propulsion device includes a second nozzle and a second reverse bucket; and when the steering wheel is operated and a steering angle of the steering wheel exceeds a predetermined threshold during a moving mode to control a thrust applied from the marine propulsion device in accordance with an operating amount of the throttle operating member, the controller is further configured or programmed to control the first reverse bucket to move to a backward moving position and the second reverse bucket to move to a forward moving position so as to turn a bow of the vessel body on the spot.

* * * * *